US010223855B2

(12) United States Patent
Yokawa et al.

(10) Patent No.: US 10,223,855 B2
(45) Date of Patent: Mar. 5, 2019

(54) PAPER SHEET HANDLING APPARATUS

(71) Applicant: GLORY LTD., Himeji-shi, Hyogo (JP)

(72) Inventors: Takeshi Yokawa, Hyogo (JP); Masayuki Akagi, Hyogo (JP); Takahiro Oe, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/549,181

(22) PCT Filed: Jan. 5, 2016

(86) PCT No.: PCT/JP2016/050157
§ 371 (c)(1),
(2) Date: Aug. 7, 2017

(87) PCT Pub. No.: WO2016/129299
PCT Pub. Date: Aug. 18, 2016

(65) Prior Publication Data

US 2018/0018847 A1 Jan. 18, 2018

(30) Foreign Application Priority Data

Feb. 9, 2015 (JP) ..... 2015-023660

(51) Int. Cl.
*G07D 11/00* (2019.01)
*B65H 31/24* (2006.01)

(52) U.S. Cl.
CPC ..... *G07D 11/0021* (2013.01); *G07D 11/0009* (2013.01); *G07D 11/0036* (2013.01);
(Continued)

(58) Field of Classification Search
CPC ..... B65H 2405/33; B65H 2405/35; B65H 31/24; G07D 11/0018; G07D 11/0021;
(Continued)

(56) References Cited

U.S. PATENT DOCUMENTS 6,123,327 A 9/2000 Holland-Letz et al.
2004/0007624 A1 1/2004 Ogawa et al.
2013/0153361 A1* 6/2013 Iizuka ..... G07D 11/0081 194/206

FOREIGN PATENT DOCUMENTS

EP 1 008 965 A1 6/2000
JP 60-86688 A 5/1985
(Continued)

OTHER PUBLICATIONS

Written Opinion of the International Searching Authority (International Application No. PCT/JP2016/050157) (11 pages—dated Jan. 3, 2016).
(Continued)

*Primary Examiner* — Howard J Sanders
(74) *Attorney, Agent, or Firm* — Renner, Kenner, Greive, Bobak, Taylor & Weber

(57) ABSTRACT

In a paper sheet handling apparatus, communication part or parts (29) are arranged in a bottom part of an upper assembly (12) and communication part or parts (42) are arranged in an upper part of a lower assembly (14) for exchanging banknotes between the upper assembly (12) and the lower assembly (14). The number of the communication part or parts (29) of the upper assembly (12) and the number of the communication part or parts (42) of the lower assembly (14) are same. The position or positions of the communication part or parts (29) of the upper assembly (12) and the position or positions of the communication part or parts (42) of the lower assembly (14) match when the upper assembly (12) or the lower assembly (14) is reversed.

18 Claims, 13 Drawing Sheets

(52) U.S. Cl.
CPC ..... *G07D 11/0081* (2013.01); *B65H 31/24* (2013.01); *B65H 2405/33* (2013.01); *B65H 2405/35* (2013.01); *G07D 11/0018* (2013.01)

(58) Field of Classification Search
CPC ..... G07D 11/0009; G07D 11/0036; G07D 11/0081
See application file for complete search history.

(56) References Cited

FOREIGN PATENT DOCUMENTS

| | | | |
|---|---|---|---|
| JP | 4-337899 | A | 11/1992 |
| JP | 5-342448 | A | 12/1993 |
| JP | 5-342457 | A | 12/1993 |
| JP | 2571410 | Y2 | 2/1998 |
| JP | 2000-172946 | A | 6/2000 |
| JP | 2004-258972 | A | 9/2004 |
| JP | 2007-26014 | A | 2/2007 |
| JP | 2008-197938 | A | 8/2008 |
| JP | 2012-150744 | A | 8/2012 |

OTHER PUBLICATIONS

Japanese Office Action with English Translation (Application No. 2016-574683) (10 pages—dated May 2, 2018).
European Search Report (Application No. 16748944.2—PCT/JP2016/050157) (7 pages—dated May 10, 2018).

* cited by examiner (a)

(b)

(a)

(b)

(a)

(b)

PAPER SHEET HANDLING APPARATUS

TECHNICAL FIELD

The present invention relates to a paper sheet handling apparatus that handles paper sheets.

BACKGROUND ART

Various types of banknote depositing and dispensing apparatuses are used conventionally as an automatic cash transaction apparatus, such as a teller machine, an ATM (automatic teller machine) and the like, installed in a financial institution and the like. In the banknote depositing and dispensing apparatus used as such an automatic cash transaction apparatus, a customer service unit operated when performing depositing process, dispensing process and the like of the banknotes, and a safe for storing the banknotes and supplying the banknotes to and collecting the banknotes from a main apparatus are arranged one above the other. As the banknote depositing and dispensing apparatus, two types of apparatuses, a front operational type and a back operational type may become necessary depending on a place of installation of the banknote depositing and dispensing apparatus. In the front operational type, a staff of the financial institution and the like operates the safe from a side on which the staff operates the customer service unit. In the back operational type, the staff operates the safe from a side that is opposite of the side on which the staff operates the customer service unit.

To meet such a requirement, Japanese Patent Application Laid-Open No. H5-342457 (JP05-342457A) discloses a banknote handling apparatus in which a customer service unit that performs deposition and/or refund of banknotes is arranged on each of a front side and a back side of a housing, whereas a safe for storing the banknotes and supplying the banknotes to and collecting the banknotes from a main apparatus is arranged on either the front side or the back side of the housing. Such a banknote handling apparatus is advantageous in that the same apparatus can be suitably used as the front operational type and the back operational type. However, because it is necessary in the banknote handling apparatus disclosed in Japanese Patent Application Laid-Open No. H5-342457 to arrange the customer service unit on each of the front side and the back side of the housing, the banknote handling apparatus upsizes and its production cost also increases.

Each of Japanese Patent Application Laid-Open No. H5-342448 (JP05-342448A) and Japanese Utility Model Registration Publication No. 2571410 (JP2571410Y) discloses a banknote handling apparatus in which one customer service unit is arranged in an upper assembly and a safe is arranged in a lower assembly, and the upper assembly is arranged so as to be reversible in a front-back direction with respect to the lower assembly. This banknote handling apparatus is advantageous in that, by reversing the upper assembly in the front-back direction with respect to the lower assembly, the same apparatus can be suitably used as the front operational type and the back operational type. However, in the banknote handling apparatuses disclosed in Japanese Patent Application Laid-Open No. H5-342448 and Japanese Utility Model Registration Publication No. 2571410, because a plurality of transport paths is arranged in a bottom part of the upper assembly and one transport path is arranged in an upper part of the lower assembly, and one transport path among the transport paths arranged in the bottom part of the upper assembly is connected to the transport path arranged in the upper part of the lower assembly, the other transport path or paths among the transport paths arranged in the bottom part of the upper assembly are not used, and those transport paths become redundant. Moreover, in such a banknote handling apparatus, because the transport path that is actually used among the transport paths arranged in the bottom part of the upper assembly changes depending on the orientation of the upper assembly whereby a control relating to a transport operation of the banknotes inside the upper assembly becomes complicated.

Japanese Patent Application Laid-Open No. 2000-172946 (JP2000-172946A) discloses a banknote depositing and dispensing machine in which a connecting transporting unit is arranged between an upper assembly, in which a customer service unit is arranged, and a lower assembly, in which a safe is arranged, and the connecting transporting unit and the lower assembly are arranged so as to be reversible in a front-back direction with respect to the upper assembly (see FIGS. 39 and 40 of Japanese Patent Application Laid-Open No. 2000-172946). This banknote depositing and dispensing machine is advantageous in that, by reversing the lower assembly in the front-back direction with respect to the upper assembly, the same apparatus can be suitably used as the front operational type and the back operational type. Moreover, because the connecting transporting unit is arranged between the upper assembly and the lower assembly, there is an advantage that no transport path in the upper assembly and the lower assembly becomes redundant. However, in the banknote depositing and dispensing machine disclosed in Japanese Patent Application Laid-Open No. 2000-172946, because a transport route of the banknotes in the upper assembly and the connecting transporting unit changes depending on the orientation of the lower assembly with respect to the upper assembly, a control relating to a transport operation of the banknotes becomes complicated.

SUMMARY OF INVENTION

The present invention has been made in view of the above discussion. One object of the present invention is to provide a paper sheet handling apparatus in which, by arranging the same number of communication parts in a bottom part of an upper assembly and in an upper part of a lower assembly, and matching position or positions of the communication part or parts of the upper assembly and position or positions of the communication part or parts of the lower assembly when either the upper assembly or the lower assembly is reversed, no redundant transport path occurs in the upper assembly and the lower assembly, allowing the same apparatus to be suitably used as the front operational type and the back operational type.

Another object of the present invention is to provide a paper sheet handling apparatus in which, by matching position or positions of the communication part or parts of the lower assembly that oppose the upper assembly and position or positions of the communication part or parts of the upper assembly when the lower assembly is reversed up-down, in a configuration in which a laterally opening door is provided in either a front surface or a back surface of the lower assembly, and reversing the lower assembly up-down, it is possible to suitably use the same apparatus as an apparatus in which the door can be opened toward the left and an apparatus in which the door can be opened toward the right.

A paper sheet handling apparatus of the present invention includes: an upper assembly having at least one of a receiving unit that receives a paper sheet and an ejecting unit that ejects the paper sheet; and a transporting unit that transports the paper sheet; and a lower assembly having a storage unit for storing the paper sheet and an inside which is accessible, at least one communication part is arranged in a bottom part of the upper assembly and at least one communication part is arranged in an upper part of the lower assembly for exchanging the paper sheet between the upper assembly and the lower assembly, the number of the communication part or parts of the upper assembly and the number of the communication part or parts of the lower assembly are the same, and a position of the communication part(s) of the upper assembly and a position of the communication part(s) of the lower assembly match when the upper assembly or the lower assembly is reversed.

In the paper sheet handling apparatus as described above, the inside of the lower assembly may be accessible from either the front or back of the lower assembly, and when the upper assembly or the lower assembly is reversed front-back, a direction from which the inside of the lower assembly is accessible may be reversed. Please note that, when the upper assembly or the lower assembly is reversed front-back, a center of a length in a front-back direction of the upper assembly or the lower assembly may be set as an axis of rotation, or a center between the position of the communication part on a foremost side and the position of the communication part on a furthest side may be set as an axis of rotation. In this way, any axis may be used as long as the connecting parts match when the upper assembly or the lower assembly is reversed front-back.

Alternatively, the inside of the lower assembly may be accessible from either left or right of the lower assembly, and when the upper assembly or the lower assembly is reversed left-right, a direction from which the inside of the lower assembly is accessible is reversed. Please note that, when the upper assembly or the lower assembly is reversed left-right, a center of a length in a left-right direction of the upper assembly or the lower assembly may be set as an axis of rotation, or a center between the position of the communication part on a rightmost side and the position of the communication part on a leftmost side may be set as an axis of rotation. In this way, any axis may be used as long as the connecting parts match when the upper assembly or the lower assembly is reversed left-right.

In the paper sheet handling apparatus as described above, the communication parts of the upper assembly and the communication parts of the lower assembly may be provided in a plurality, and the position of each of the communication parts of the lower assembly may matche with the position of the corresponding communication part of the upper assembly when the upper assembly or the lower assembly is reversed.

In this case, the communication parts of the upper assembly may be arranged symmetrically with respect to a substantially central position in a front-back direction of the upper assembly.

Further, the communication parts of the upper assembly may be arranged symmetrically with respect to a substantially central position in a width direction that is orthogonal to the front-back direction of the upper assembly.

Further, the communication parts of the lower assembly may be arranged symmetrically with respect to a substantially central position in a front-back direction of the lower assembly.

Further, the communication parts of the lower assembly may be arranged symmetrically with respect to a substantially central position in a width direction that is orthogonal to the front-back direction of the lower assembly.

In the paper sheet handling apparatus as described above, the paper sheet sent from the communication part of the upper assembly to the communication part of the lower assembly may be stored in the storage unit of the lower assembly without being diverted.

In this case, the storage units may be provided in a plurality, and all the storage units may have the same configuration.

Further, the number of the storage units and the number of the communication parts may be the same.

In the paper sheet handling apparatus as described above, a plurality of the storage units may be arranged side by side along a horizontal direction inside the lower assembly.

In the paper sheet handling apparatus as described above, the lower assembly may constitute a safe into which only a person having a predetermined authority is capable of accessing the inside of the lower assembly, and the communication part may be an opening part provided in the safe.

In the paper sheet handling apparatus as described above, a paper sheet that should be stored in the storage unit of the lower assembly from among the paper sheets that are received inside the upper assembly via the receiving unit of the upper assembly may be sent from the communication part of the upper assembly to the communication part of the lower assembly, and a paper sheet that should be returned may be ejected from the ejecting unit to the outside of the paper sheet handling apparatus.

In the paper sheet handling apparatus as described above, the communication part or parts of the upper assembly number the same as the communication part or parts arranged in a bottom part of the lower assembly, and a position of each of the communication part or parts of the lower assembly that oppose the upper assembly and a position of the corresponding communication part or parts of the upper assembly may match when the lower assembly is reversed up-down.

In this case, a laterally opening door may be arranged on either a front surface or a back surface of the lower assembly, and the door may be configured so that an opening direction thereof is reversed when the lower assembly is reversed up-down.

The paper sheet handling apparatus as described above may further include a lower assembly control unit arranged inside the lower assembly for controlling each structural component of the lower assembly; an upper assembly control unit arranged inside the upper assembly for controlling each structural component of the upper assembly; an upper assembly connecting unit to be connected to the lower assembly control unit; two lower assembly connecting units to be connected to the upper assembly control unit; a first detecting unit that detects which between the two lower assembly connecting units the upper assembly connecting unit is connected when connecting the upper assembly control unit and the lower assembly control unit to each other; and a first determining unit that determines an orientation of the lower assembly with respect to the upper assembly based on a detection result obtained in the first detecting unit.

In this case, the paper sheet handling apparatus as described above may further include a display unit, and a display content of the display unit may be changed based on the determination result obtained in the first determining unit.

The paper sheet handling apparatus as described above may further include a lower assembly control unit arranged inside the lower assembly for controlling each structural component of the lower assembly; an upper assembly control unit arranged inside the upper assembly for controlling each structural component of the upper assembly; an upper assembly connecting unit to be connected to the lower assembly control unit; a lower assembly connecting unit to be connected to the upper assembly control unit; a second detecting unit that detects whether the upper assembly connecting unit is directly connected to the lower assembly connecting unit or connected via a connection assisting unit when connecting the upper assembly control unit and the lower assembly control unit to each other; and a second determining unit that determines an orientation of the lower assembly with respect to the upper assembly based on a detection result obtained in the second detecting unit.

In this case, the paper sheet handling apparatus as described above may further include a display content of the display unit is changed based on the determination result obtained in the second determining unit.

A paper sheet handling apparatus of the present invention includes: an upper assembly having at least one of a receiving unit that receives a paper sheet and an ejecting unit that ejects the paper sheet; and a transporting unit that transports the paper sheet; and a lower assembly having a storage unit for storing the paper sheet and an inside which is accessible, at least one communication part is arranged in a bottom part of the upper assembly and at least one communication part is arranged respectively in an upper part and a bottom part of the lower assembly for exchanging the paper sheet between the upper assembly and the lower assembly, the number of the communication part or parts of the upper assembly, the number of the communication part or parts arranged in the upper part of the lower assembly and the number of the communication part or parts arranged in the bottom part of the lower assembly are the same, and a position of each of the communication part or parts of the lower assembly that oppose the upper assembly and a position of the corresponding communication part or parts of the upper assembly match when the lower assembly is reversed up-down.

In the paper sheet handling apparatus as described above, a laterally opening door may be arranged on either a front surface or a back surface of the lower assembly, and the door may be configured so that an opening direction thereof is reversed when the lower assembly is reversed up-down.

BRIEF DESCRIPTION OF DRAWINGS

FIG. 3 is an explanatory view indicating positions of communication parts of an upper assembly and positions of communication parts of the lower assembly in the banknote handling apparatus shown in FIG. 1 and the like.

FIG. 4 is a functional block diagram indicating a configuration of a control system in the banknote handling apparatus shown in FIG. 1 and the like.

DESCRIPTION OF EMBODIMENT

Figure 1:
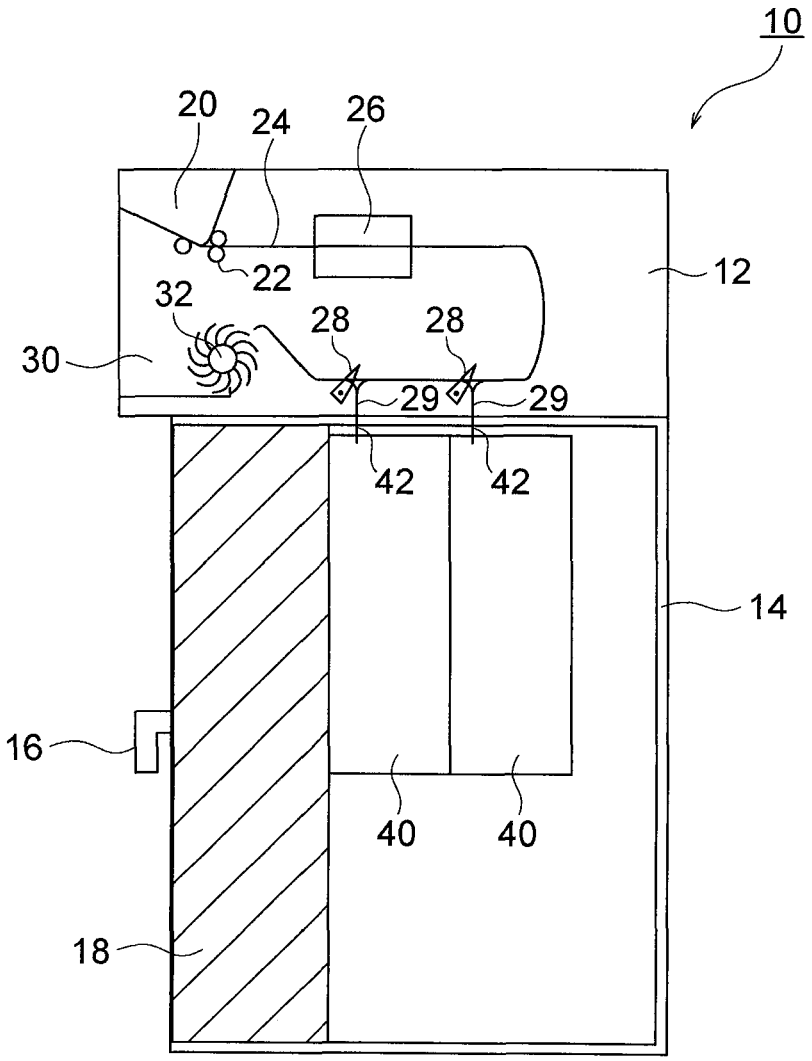
FIG. 1 is a schematic configurational diagram of an overall configuration of a banknote handling apparatus according to an embodiment of the present invention.
Figure 2:
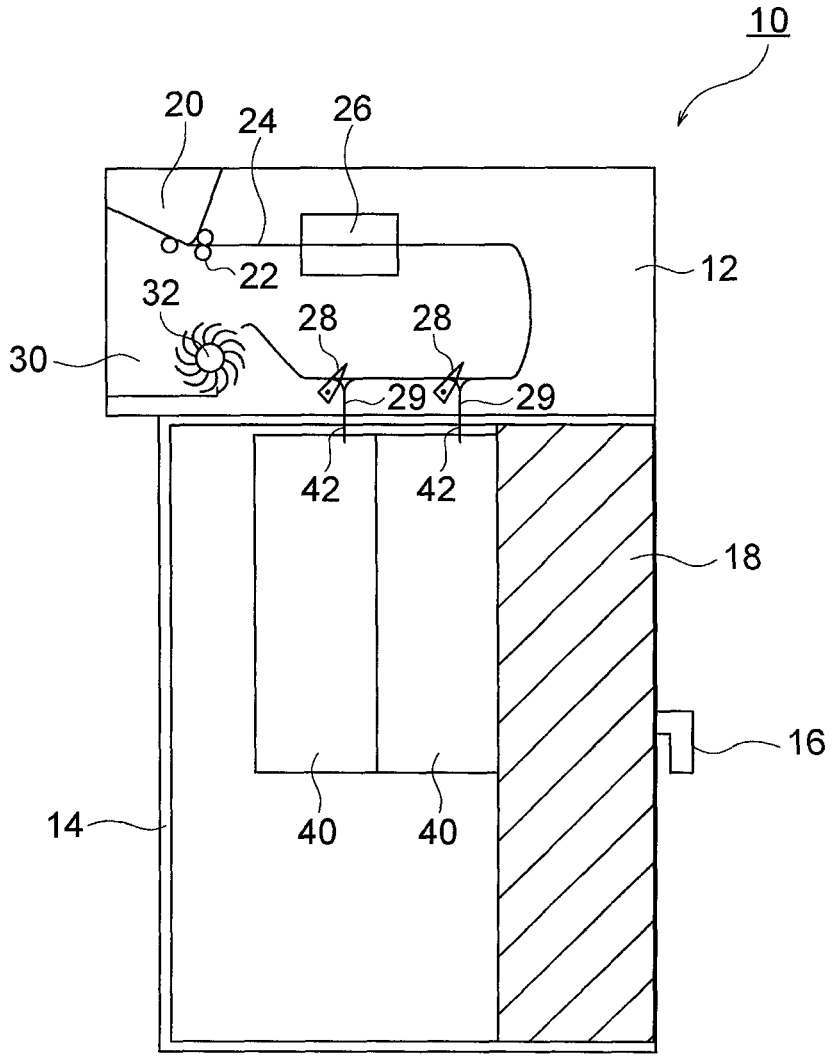
FIG. 2 is a schematic configurational diagram of an overall configuration of the banknote handling apparatus shown in FIG. 1 when a lower assembly is reversed front-back.
Figure 3:
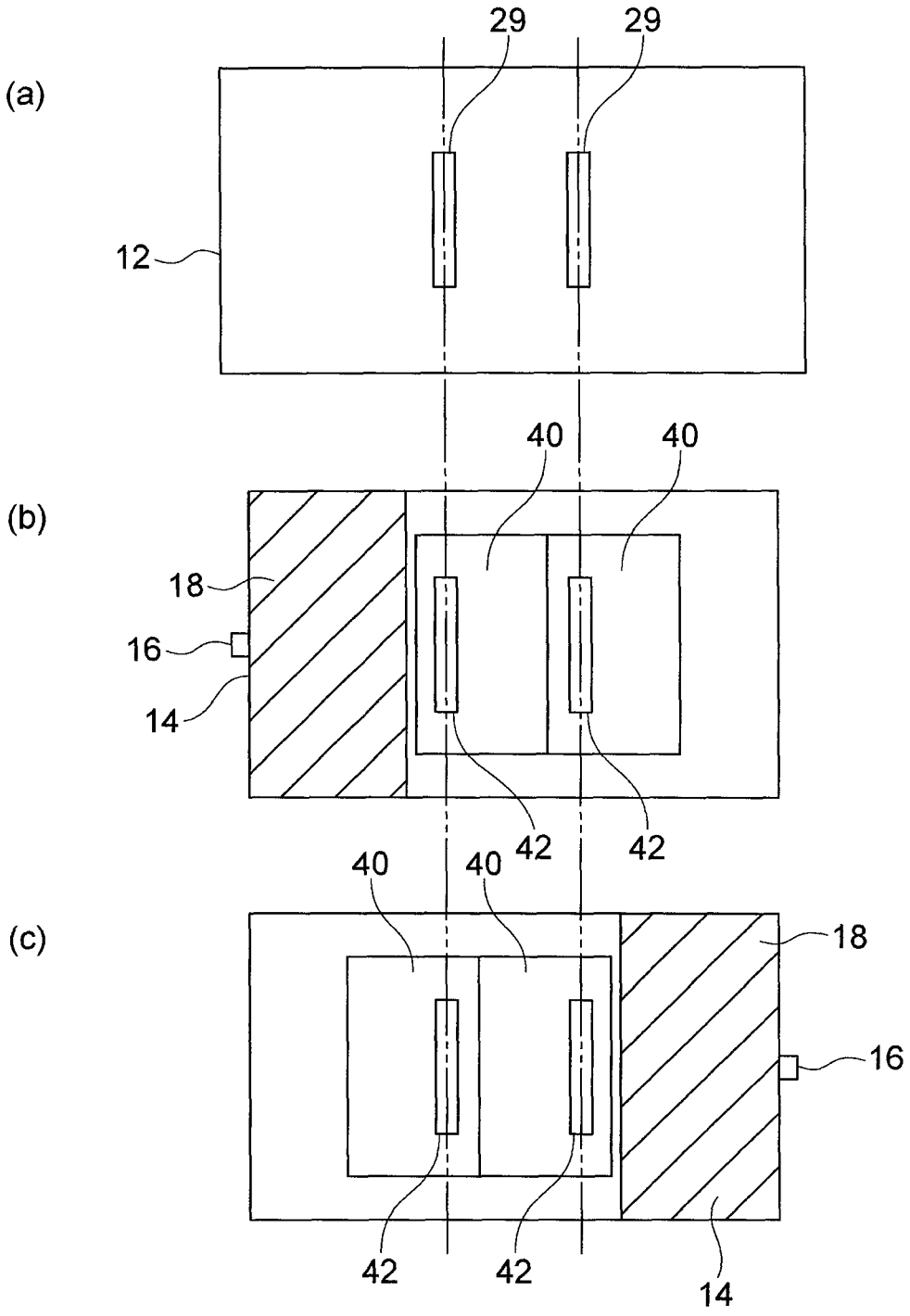
Figure 4:
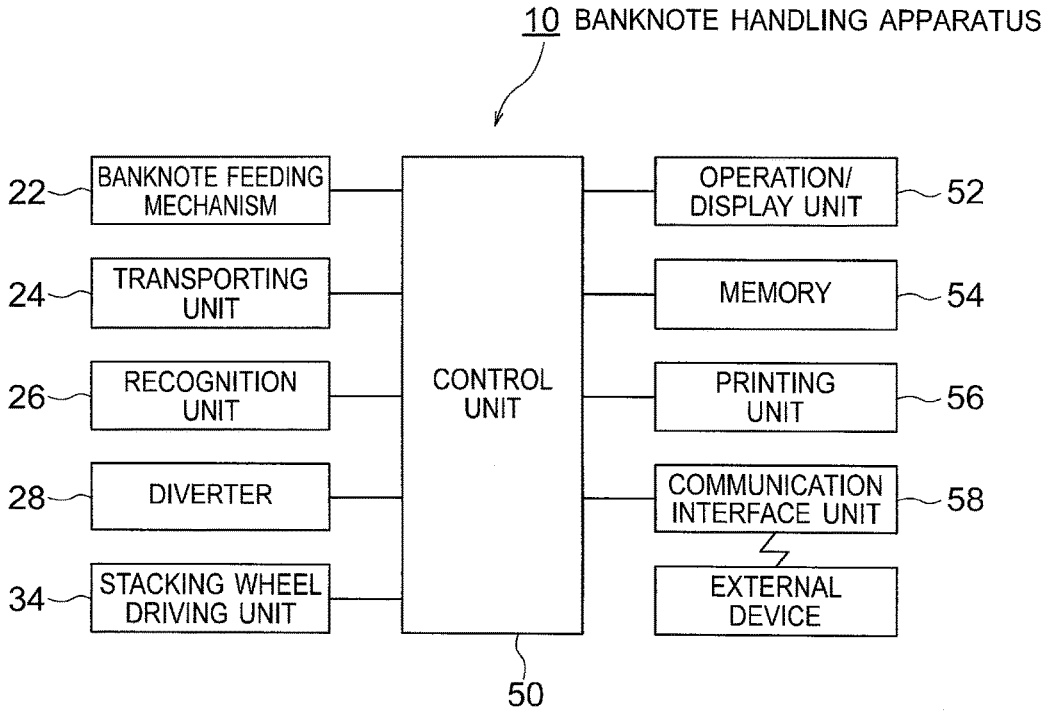
Figure 5:
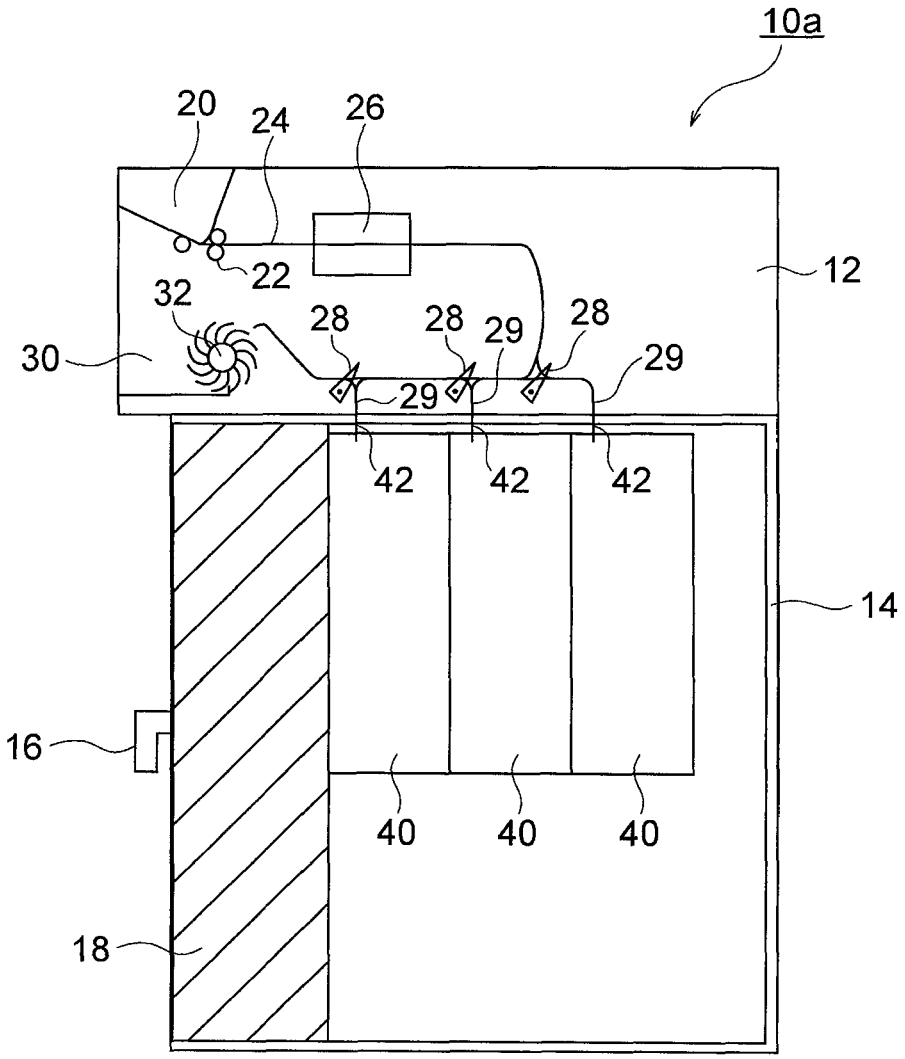
FIG. 5 is a schematic configurational diagram of another overall configuration of a banknote handling apparatus according to an embodiment of the present invention.
Figure 6:
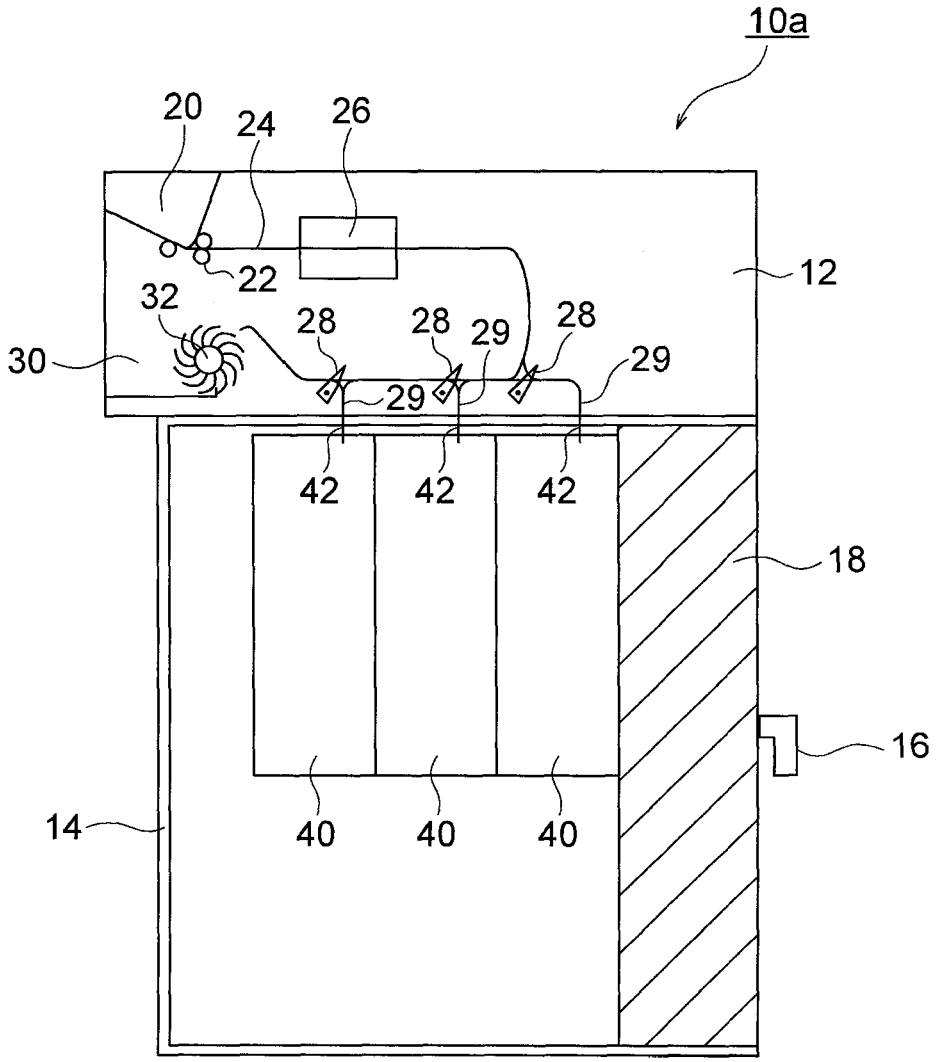
FIG. 6 is a schematic configurational diagram of an overall configuration of the banknote handling apparatus shown in FIG. 5 when a lower assembly is reversed front-back.

Exemplary embodiments of the present invention are explained below with reference to the accompanying drawings. FIGS. 1 to 6 are views indicating a banknote handling apparatus according to the present embodiment. Of these, FIG. 1 is a schematic configurational diagram of an overall configuration of a banknote handling apparatus according to the present embodiment, and FIG. 2 is a schematic configurational diagram of an overall configuration of the banknote handling apparatus shown in FIG. 1 when a lower assembly is reversed front-back. FIG. 3 is an explanatory view indicating positions of communication parts of an upper assembly and positions of communication parts of the lower assembly in the banknote handling apparatus shown in FIG. 1 and the like. FIG. 4 is a functional block diagram indicating a configuration of a control system in the banknote handling apparatus shown in FIG. 1 and the like. FIG. 5 is a schematic configurational diagram of another overall configuration of a banknote handling apparatus according to the present embodiment. FIG. 6 is a schematic configurational diagram of an overall configuration of the banknote handling apparatus shown in FIG. 5 when a lower assembly is reversed front-back.

As shown in FIG. 1, a banknote handling apparatus 10 according to the present embodiment includes an upper assembly 12 placed on a lower assembly 14. The upper assembly 12 includes a receiving unit 20 such as a hopper that receives a plurality of banknotes, a banknote feeding mechanism 22 that feeds out the banknotes received by the receiving unit 20 one by one to the inside of the upper assembly 12, a transporting unit 24 arranged inside the upper assembly 12 for transporting the banknote fed out by the banknote feeding mechanism 22 from the receiving unit 20, a recognition unit 26 arranged in the transporting unit 24 for recognizing a banknote that is transported by the transporting unit 24, and an ejecting unit 30 connected to the transporting unit 24 and that ejects a banknote to the outside from the inside of the upper assembly 12. Note that, in the banknote handling apparatus 10 shown in FIG. 1, a surface on the left side of the upper assembly 12 and the lower assembly 14 (that is, a surface on a side on which the receiving unit 20 and the ejecting unit 30 are arranged) is a front surface of the banknote handling apparatus 10, and a surface on the right side of the upper assembly 12 and the lower assembly 14 is a back surface of the banknote handling apparatus 10. A left-right direction in FIG. 1 is a front-back direction of the banknote handling apparatus 10, and a direction orthogonal to the surface of a paper sheet of FIG. 1 (that is, a direction that comes toward the reader or goes away from the reader from the surface of the paper sheet of FIG. 1) is a width direction of the banknote handling apparatus 10.

The receiving unit 20 and the ejecting unit 30 opens on a front surface of the upper assembly 12. An operator can access the receiving unit 20 and the ejecting unit 30 via this opening from the outside of the upper assembly 12. Accordingly, the operator can set the banknotes in the receiving unit 20, and can remove from the ejecting unit 30 the banknotes stacked in the ejecting unit 30.

The banknote feeding mechanism 22 includes a kicker roller that kicks a bottommost banknote among the banknotes received by the receiving unit 20 toward the inside of the upper assembly 12, a feeding roller that feeds out banknotes inside the upper assembly 12 one by one that has been kicked by the kicker roller, and an opposing roller arranged opposing the feeding roller for separating banknotes piece by piece between the feeding roller. The banknotes fed out by the feeding roller of the banknote feeding mechanism 22 from the receiving unit 20 to the inside of the upper assembly 12 are transported one by one by the transporting unit 24.

Denomination, authenticity, front/back (whether face side up or back side up), fitness, version (new/old), transportation state, and the like of the banknote being transported by the transporting unit 24 are recognized by the recognition unit 26. A banknote that is recognized by the recognition unit 26 as a normal banknote is sent to a later-explained banknote storage cassette 40 arranged in the lower assembly 14. Meanwhile, a banknote that is recognized by the recognition unit 26 as not a normal banknote is sent as a reject banknote to the ejecting unit 30. Accordingly, the operator can remove the reject banknote from the ejecting unit 30 and set the reject banknote in the receiving unit 20 again.

As shown in FIG. 1, a stacking wheel 32 for aligning the banknotes sent to the ejecting unit 30 from the transporting unit 24 is arranged in the inner side of the ejecting unit 30 of the upper assembly 12. The stacking wheel 32 is rotated in the counterclockwise direction in FIG. 1 by a stacking wheel driving unit 34 (see FIG. 4). Each of the banknotes sent to the stacking wheel 32 from the transporting unit 24 is received between two blades of the stacking wheel 32. When the stacking wheel 32 rotates in the counterclockwise direction in FIG. 1 with the banknote being held between the two blades, the banknote released from between the two blades of the stacking wheel 32 is stacked in an aligned manner in the ejecting unit 30.

Inside the lower assembly 14 are mounted a plurality of the banknote storage cassettes 40 (two in the example shown in FIG. 1) side by side in one or more rows (one row in the example shown in FIG. 1) along the horizontal direction. The banknotes are stored in a stacked manner in each of the banknote storage cassettes 40. Moreover, the banknotes are stored according to a denomination of the banknotes in each of the banknote storage cassettes 40. Moreover, a plurality of diverters 28, each corresponding to each of the banknote storage cassettes 40, is arranged in the transporting unit 24 of the upper assembly 12. The banknote that is recognized by the recognition unit 26 as a normal banknote and transported downstream of the recognition unit 26 by the transporting unit 24 is diverted from the transporting unit 24 by a corresponding diverter 28, for example, according to the denomination of the banknote, to a corresponding banknote storage cassette 40. More particularly, communication parts 29 are arranged in a bottom part of the upper assembly 12 and communication parts 42 are arranged in an upper part of the lower assembly 14 for exchanging the banknotes between the upper assembly 12 and the lower assembly 14, and the banknote diverted from the transporting unit 24 by a corresponding diverter 28 is sent to a corresponding banknote storage cassette 40 after passing through corresponding communication parts 29 and 42. A configuration of each of the communication parts 29 and 42 will be explained later.

A laterally opening door 18 is arranged on a front surface of the lower assembly 14. The door 18 is provided with a handle 16. The door 18 is provided with a lock mechanism (not shown). Only an operator having predetermined authority (for example, the staff of the financial institution and the like) can unlock the lock mechanism by using a predetermined key and open the door 18. After opening the door 18 of the lower assembly 14, the operator can remove from the inside of the lower assembly 14 the banknote storage cassette 40 in which the banknotes have been stored thereby collecting the banknotes together with the banknote storage cassette 40, and mount an empty banknote storage cassette 40 inside the lower assembly 14. In this manner, the inside of the lower assembly 14 can be accessed from the front surface of the lower assembly 14. Moreover, the lower assembly 14 constitutes a safe into which only a person having the predetermined authority can access the inside of the lower assembly 14.

The banknote handling apparatus 10 according to the present embodiment includes a control unit 50 that controls various structural components of the banknote handling apparatus 10. More particularly, as shown in FIG. 4, the banknote feeding mechanism 22 arranged in the receiving unit 20, the transporting unit 24, the recognition unit 26, the diverters 28, and the stacking wheel driving unit 34 that drives the stacking wheel 32 arranged in the inner side of the ejecting unit 30 are connected communicably to the control unit 50. A signal representing a recognition result of the banknote obtained by the recognition unit 26 is sent to the control unit 50. Moreover, the control unit 50 controls the operations of these structural components by sending a command signal to each of the structural components of the banknote handling apparatus 10.

As shown in FIG. 4, an operation/display unit 52, a memory 54, a printing unit 56, and a communication interface unit 58 are connected communicably to the control unit 50. The operation/display unit 52 is constituted by, for example, a touch screen and the like arranged on the front surface or the top surface of the upper assembly 12. The progress of depositing process and the like of the banknotes in the banknote handling apparatus 10, and information about inventory amounts and the like of the banknotes stored in each of the banknote storage cassettes 40 are displayed on the operation/display unit 52. Moreover, the operator can send various commands to the control unit 50 by operating the operation/display unit 52. The operation/display unit 52 can have a movable structure or a rotatable structure that makes it possible for the operation/display unit 52 to be operated from either the front surface or the back surface of the banknote handling apparatus 10. Alternatively, the configuration can be arranged such that one operation/display unit 52 is arranged on the front surface of the banknote handling apparatus 10 and another operation/display unit 52 is arranged on the back surface of the banknote handling apparatus 10.

A handling history of depositing process and the like of the banknotes in the banknote handling apparatus 10, and the information about the inventory amounts and the like of the banknotes stored in each of the banknote storage cassettes 40 are stored in the memory 54. The printing unit 56 prints on a receipt and the like the handling history of depositing process and the like of the banknotes in the banknote handling apparatus 10, and the information about the inventory amounts and the like of the banknotes stored in each of the banknote storage cassettes 40. The control unit 50 can transmit to and receive from an external device (specifically, for example, a host terminal) arranged separately from the banknote handling apparatus 10 according to the present embodiment a signal via the communication interface unit 58.

An operation of the banknote handling apparatus 10 having such a configuration is explained below. The operation of the banknote handling apparatus 10 explained below is performed by the control unit 50 by controlling the various structural components of the banknote handling apparatus 10.

An operation executed when depositing process of the banknotes is performed in the banknote handling apparatus 10 is explained below. After setting the banknotes in the receiving unit 20 in a stacked manner, the operator gives a command to start depositing process to the control unit 50 by using the operation/display unit 52. As a result, the banknotes set in the receiving unit 20 are fed out one by one by the banknote feeding mechanism 22 to the inside of the upper assembly 12, and the banknotes are transported one by one by the transporting unit 24. The denomination, authenticity, front/back (whether face side up or back side up), fitness, version (new/old), transportation state, and the like of the banknote being transported by the transporting unit 24 are recognized by the recognition unit 26. The banknote that is recognized by the recognition unit 26 as not a normal banknote, that is, the reject banknote, is sent to the ejecting unit 30 by the transporting unit 24, and the banknote is stacked in the ejecting unit 30. Accordingly, the operator can manually remove from the front surface of the upper assembly 12 the reject banknote stacked in the ejecting unit 30 and set the reject banknote in the receiving unit 20 again. In contrast, the banknote that is recognized by the recognition unit 26 as a normal banknote is diverted, according to the denomination of the banknote, by the corresponding diverter 28 from the transporting unit 24 and sent to the corresponding banknote storage cassette 40 via the corresponding communication parts 29 and 42, and the banknote is stored in the banknote storage cassette 40.

In the present embodiment, the lower assembly 14 can be reversed front-back. FIG. 2 is a view indicating a configuration when the lower assembly 14 is reversed front-back from the state thereof in the banknote handling apparatus 10 shown in FIG. 1. As shown in FIG. 2, when the lower assembly 14 is reversed, the receiving unit 20 and the ejecting unit 30 of the upper assembly 12 and the handle 16 and the door 18 of the lower assembly 14 mutually face in opposite directions. In this manner, in the present embodiment, the same banknote handling apparatus 10 can be used as a front operational type and a back operational type. When the banknote handling apparatus 10 is used as the front operational type, opening and closing of the door 18 of the lower assembly 14 is performed from the side that is the same as the side on which the receiving unit 20 and the ejecting unit 30 are arranged in the upper assembly 12. When the banknote handling apparatus 10 is used as the back operational type, the opening and closing of the door 18 of the lower assembly 14 is performed from an opposite side of the side on which the receiving unit 20 and the ejecting unit 30 are arranged in the upper assembly 12.

Moreover, in the present embodiment, when the lower assembly 14 is reversed front-back from the state thereof shown in FIG. 1, positions of the communication parts 29 of the upper assembly 12 and positions of the communication parts 42 of the lower assembly 14 match. This technical feature is explained below by using FIG. 3. FIG. 3(*a*) is a view of a configuration when the communication parts 29 arranged in the bottom part of the upper assembly 12 in the banknote handling apparatus 10 shown in FIG. 1 are seen from an upper side to a lower side of the upper assembly 12. FIG. 3(*b*) is a view of a configuration when the communication parts 42 arranged in the upper part of the lower assembly 14 in the banknote handling apparatus 10 shown in FIG. 1 are seen from an upper side to a lower side of the lower assembly 14. FIG. 3(*c*) is a view of a configuration when the communication parts 42 arranged in the upper part of the lower assembly 14 are seen from the upper side to the lower side of the lower assembly 14 in a situation in which the lower assembly 14 is reversed front-back from the state thereof in the banknote handling apparatus 10 shown in FIG. 1 (that is, the state of the lower assembly 14 in the banknote handling apparatus 10 shown in FIG. 2).

In the present embodiment, the number of the communication parts 29 arranged in the bottom part of the upper assembly 12 and the number of the communication parts 42 arranged in the upper part of the lower assembly 14 are same. Moreover, as shown with a two-dot chain line in FIGS. 3(*a*) and 3(*b*), in the front-back direction (that is a left-right direction in FIG. 3) of the banknote handling apparatus 10, the position of each of the communication parts 29 and the position of the corresponding communication part 42 are same. Also, in the width direction (that is, an up-down direction in FIG. 3) of the banknote handling apparatus 10, the position of each of the communication parts 29 and the position of the corresponding communication part 42 are same. Accordingly, the banknotes that are diverted by each diverter 28 from the transporting unit 24 in the upper assembly 12 are sent to the banknote storage cassettes 40 smoothly without being caught in the communication parts 29 and 42.

Moreover, in the present embodiment, when the lower assembly 14 is reversed front-back, the position of each of the communication parts 42 of the lower assembly 14 matches with the position of the corresponding communication part 29 of the upper assembly 12. More particularly, the communication parts 29 of the upper assembly 12 are arranged symmetrically with respect to a substantially central position in a front-back direction (that is, the left-right direction in FIG. 3) of the upper assembly 12. Also, the communication parts 42 of the lower assembly 14 are arranged symmetrically with respect to a substantially central position in a front-back direction of the lower assembly 14. Moreover, the communication parts 29 of the upper assembly 12 are arranged symmetrically with respect to a substantially central position in a width direction (that is, the up-down direction in FIG. 3) of the upper assembly 12. Also, the communication parts 42 of the lower assembly 14 are arranged symmetrically with respect to a substantially central position in a width direction of the lower assembly 14. Accordingly, even when the lower assembly 14 is reversed front-back from the state thereof in the banknote handling apparatus 10 shown in FIG. 1, as shown with a two-dot chain line in FIGS. 3(*a*) and 3(*c*), in the front-back direction (that is, the left-right direction in FIG. 3) of the banknote handling apparatus 10, the position of each of the communication parts 29 and the position of the corresponding communication part 42 will match, and in the width direction (that is, the up-down direction in FIG. 3) of the banknote handling apparatus 10, the position of each of the communication parts 29 and the position of the corresponding communication part 42 will match. Therefore, even when the lower assembly 14 is reversed front-back from the state thereof in the banknote handling apparatus 10 shown in FIG. 1, the banknotes that are diverted by the diverters 28 from the transporting unit 24 in the upper assembly 12 are sent to the banknote storage cassettes 40 smoothly without being caught in the communication parts 29 and 42.

Note that, the positions of the communication parts 29 need not be exactly symmetrical with respect to the substantially central position in the front-back direction or the width direction of the upper assembly 12. That is, it is permissible that the positions of the communication parts 29 are somewhat shifted from the positions that are symmetrical with respect to the central position in the front-back direction or the width direction of the upper assembly 12. Similarly, the positions of the communication parts 42 need not be exactly symmetrical with respect to the substantially central position in the front-back direction or the width direction of the lower assembly 14. That is, it is permissible that the positions of the communication parts 42 are somewhat shifted from the positions that are symmetrical with respect to the central position in the front-back direction or the width direction of the lower assembly 14.

In the present embodiment, the communication parts 42 and the banknote storage cassettes 40 are arranged in one to one correspondence in the lower assembly 14, and the banknote sent from the communication part 29 of the upper assembly 12 to the communication part 42 of the lower assembly 14 is directly stored in the banknote storage cassette 40 via the communication part 42 by the weight of the banknote. That is, the banknote sent from the communication part 29 of the upper assembly 12 to the communication part 42 of the lower assembly 14 is directly stored in the banknote storage cassette 40 of the lower assembly 14 without going through the diverter that diverts the transported banknote or a face-back side reversing unit that reverses the side of the transported banknote. Moreover, all the banknote storage cassettes 40 (two in the example shown in FIG. 1) have the same configuration. Accordingly, in the present embodiment, even when the lower assembly 14 is reversed front-back, without changing the control contents of the operation of the transporting unit 24 and the diverters 28 by the control unit 50, the banknotes taken inside the upper assembly 12 from the receiving unit 20 can be stored in the banknote storage cassettes 40 after having been subjected to the recognition by the recognition unit 26. Moreover, in this case, occurrence of an error such as jamming can be prevented when the banknotes are stored in the banknote storage cassettes 40 in the lower assembly 14.

In the present embodiment, the number of the banknote storage cassettes 40 mounted in the lower assembly of the banknote handling apparatus is not limited to two. As shown in FIGS. 5 and 6, a banknote handling apparatus 10*a* in which three banknote storage cassettes 40 are mounted side by side along the horizontal direction inside the lower assembly 14 can be used. Moreover, as another example, it is allowable to use a banknote handling apparatus in which four or more banknote storage cassettes 40 are mounted side by side along the horizontal direction in one or more rows inside the lower assembly 14 can be used. Note that, in the explanation of the banknote handling apparatus 10*a* shown in FIGS. 5 and 6, the same reference numbers have been used for the structural components that are the same as those in the banknote handling apparatus 10 shown in FIGS. 1 to 4 and the explanation thereof has been omitted.

The lower assembly 14 can be reversed front-back even in the banknote handling apparatus 10*a*, like the one shown in FIG. 5, in which three banknote storage cassettes 40 are mounted side by side along the horizontal direction in one row inside the lower assembly 14. FIG. 6 is a view indicating a configuration when the lower assembly 14 is reversed front-back from the state thereof in the banknote handling apparatus 10*a* shown in FIG. 5. As shown in FIG. 6, when the lower assembly 14 is reversed, the receiving unit 20 and the ejecting unit 30 of the upper assembly 12 and the handle 16 and the door 18 of the lower assembly 14 mutually face in opposite directions. In this manner, even in the banknote handling apparatus 10*a* shown in FIGS. 5 and 6, the same banknote handling apparatus 10*a* can be used as the front operational type and the back operational type. When the banknote handling apparatus 10*a* is used as the front operational type, opening and closing of the door 18 of the lower assembly 14 is performed from the side that is the same as the side on which the receiving unit 20 and the ejecting unit 30 are arranged in the upper assembly 12. When the banknote handling apparatus 10*a* is used as the back operational type, the opening and closing of the door 18 of the lower assembly 14 is performed from an opposite side of the side on which the receiving unit 20 and the ejecting unit 30 are arranged in the upper assembly 12.

In the banknote handling apparatus 10*a* shown in FIGS. 5 and 6, when the lower assembly 14 is reversed front-back from the state thereof shown in FIG. 5, the positions of the communication parts 29 of the upper assembly 12 and the positions of the communication parts 42 of the lower assembly 14 match. Specifically, in the banknote handling apparatus 10*a* shown in FIGS. 5 and 6, the number of the communication parts 29 arranged in the bottom part of the upper assembly 12 and the number of the communication parts 42 arranged in the upper part of the lower assembly 14 are same. Moreover, in a front-back direction (that is, a left-right direction in FIGS. 5 and 6) of the banknote handling apparatus 10*a*, the position of each of the communication parts 29 and the position of the corresponding communication part 42 are same. Also, in a width direction (that is, a direction orthogonal to the surface of paper sheets of FIGS. 5 and 6) of the banknote handling apparatus 10*a*, the position of each of the communication parts 29 and the position of the corresponding communication part 42 are same. Accordingly, the banknotes that are diverted by each diverter 28 from the transporting unit 24 in the upper assembly 12 are sent to the banknote storage cassettes 40 smoothly without being caught in the communication parts 29 and 42.

In the banknote handling apparatus 10*a* shown in FIGS. 5 and 6, the position of each of the communication parts 42 of the lower assembly 14 matches with the position of the corresponding communication part 29 of the upper assembly 12 when the lower assembly 14 is reversed front-back. More particularly, the communication parts 29 of the upper assembly 12 are arranged symmetrically with respect to a substantially central position in the front-back direction (that is, the left-right direction in FIGS. 5 and 6) of the upper assembly 12. Also, the communication parts 42 of the lower assembly 14 are arranged symmetrically with respect to a substantially central position in the front-back direction of the lower assembly 14. Moreover, the communication parts 29 of the upper assembly 12 are arranged symmetrically with respect to a substantially central position in the width direction (that is, the direction orthogonal to the surface of paper sheets of FIGS. 5 and 6) of the upper assembly 12. Also, the communication parts 42 of the lower assembly 14 are arranged symmetrically with respect to a substantially central position in the width direction of the lower assembly 14. Accordingly, even when the lower assembly 14 is reversed front-back from the state thereof in the banknote handling apparatus 10*a* shown in FIG. 5, in the front-back direction of the banknote handling apparatus 10*a*, the position of each of the communication parts 29 and the position of the corresponding communication part 42 will match, and in the width direction of the banknote handling apparatus 10*a*, the position of each of the communication parts 29 and the position of the corresponding communication part 42 will match. Therefore, even when the lower assembly 14 is reversed front-back from the state thereof in the banknote handling apparatus 10*a* shown in FIG. 5, the banknotes that are diverted by each diverter 28 from the transporting unit 24 in the upper assembly 12 are sent to the banknote storage cassettes 40 smoothly without being caught in the communication parts 29 and 42.

According to the banknote handling apparatuses 10 and 10*a* of the present embodiment having the above-explained configuration, the communication parts 29 are arranged in the bottom part of the upper assembly 12 and the communication parts 42 are arranged in the upper part of the lower assembly 14 for exchanging the banknotes between the upper assembly 12 and the lower assembly 14, the number of the communication parts 29 of the upper assembly 12 and the number of the communication parts 42 of the lower assembly 14 are same, and the positions of the communication parts 29 of the upper assembly 12 and the positions of the communication parts 42 of the lower assembly 14 match when the lower assembly 14 is reversed front-back. In these banknote handling apparatuses 10 and 10*a*, no redundant transport path occurs in the upper assembly 12 and the lower assembly 14, allowing the same apparatus to be suitably used as the front operational type and the back operational type.

In the banknote handling apparatuses 10 and 10*a* according to the present embodiment, as explained above, the inside of the lower assembly 14 can be accessed from either the front surface or the back surface of the lower assembly 14. When the lower assembly 14 is reversed front-back, the direction from which the inside of the lower assembly 14 is accessed is reversed. The present embodiments, however, are not limited to the above embodiments. In a banknote handling apparatus according to a variation, the inside of the lower assembly 14 can be accessed from either a left surface or a right surface of the lower assembly 14 (that is, the door 18 is provided on a side surface of the lower assembly 14), and this lower assembly 14 can be reversed left-right. In other words, the surface on which the receiving unit 20 and the ejecting unit 30 are arranged in the upper assembly 12 and the surface on which the door 18 is arranged in the lower assembly 14 are arrange adjacent to each other, with an angle of 90 degrees therebetween, across a corner of the banknote handling apparatuses 10 and 10*a*. Even in this configuration, when the lower assembly 14 is reversed left-right, the direction from which the inside of the lower assembly 14 is accessed is reversed.

In the banknote handling apparatuses 10 and 10*a* according to the present embodiment, as explained above, the communication parts 29 of the upper assembly 12 and the communication parts 42 of the lower assembly 14 are provided in plurality, the position of each of the communication parts 42 of the lower assembly 14 matches with the position of the corresponding communication part 29 of the upper assembly 12 when the lower assembly 14 is reversed. The communication parts 29 of the upper assembly 12 are arranged symmetrically with respect to a substantially central position in the front-back direction (that is, the left-right direction in FIG. 3) of the upper assembly 12. Also, the communication parts 29 of the upper assembly 12 are arranged symmetrically with respect to a substantially central position in the width direction (that is, the up-down direction in FIG. 3) of the upper assembly 12. Moreover, the communication parts 42 of the lower assembly 14 are arranged symmetrically with respect to a substantially central position in the front-back direction (that is, the left-right direction in FIG. 3) of the lower assembly 14. Also, the communication parts 42 of the lower assembly 14 are arranged symmetrically with respect to a substantially central position in the width direction (that is, the up-down direction in FIG. 3) of the lower assembly 14.

In the banknote handling apparatuses 10 and 10*a* according to the present embodiment, as explained above, the banknote sent from the communication part 29 of the upper assembly 12 to the communication part 42 of the lower assembly 14 is stored in the banknote storage cassette 40 of the lower assembly 14 without being diverted. In the present embodiment, all the banknote storage cassettes 40 have the same configuration. Furthermore, the number of the banknote storage cassette 40 can be an even number (see the banknote handling apparatus 10 shown in FIGS. 1 to 4) or can be an odd number (see the banknote handling apparatus 10*a* shown in FIGS. 5 and 6). In this case, even when the lower assembly 14 is reversed front-back, without changing the control contents of the operation of the transporting unit 24 and the diverters 28 by the control unit 50, the banknotes taken inside the upper assembly 12 from the receiving unit 20 can be stored in the banknote storage cassettes 40 after having been subjected to the recognition by the recognition unit 26. Moreover, in this case, occurrence of an error such as jamming can be prevented when the banknotes are stored in the banknote storage cassettes 40 in the lower assembly 14. In the present embodiments, the number of the banknote storage cassettes 40 as storage units and the number of the communication parts 29 and 42 are same. In the present embodiments, it is not necessary that all the banknote storage cassettes 40 have the same configuration. That is, it is allowable that some or all of the banknote storage cassettes 40 have different configuration than others. As the storage unit for storing the banknotes, a banknote storage bag can be used instead of the banknote storage cassette 40.

In the banknote handling apparatuses 10 and 10*a* according to the present embodiment, as explained above, inside the lower assembly 14 are arranged the banknote storage cassettes 40 side by side in one or more rows along the horizontal direction. The lower assembly 14 constitutes a safe into which only a person having the predetermined authority can access the inside of the lower assembly 14, and the communication parts 42 is an opening part provided in the safe.

In the banknote handling apparatuses 10 and 10*a* according to the present embodiment, as explained above, the banknotes that should be stored in the banknote storage cassettes 40 of the lower assembly 14 (that is, the banknotes that are recognized by the recognition unit 26 as normal banknotes) among the banknotes that are received inside the upper assembly 12 from the receiving unit 20 of the upper assembly 12 can be sent from the communication parts 29 of the upper assembly 12 to the communication parts 42 of the lower assembly 14, and the banknotes that should be returned are sent to the ejecting unit 30 so that these banknotes can be removed outside of the upper assembly 12 from the ejecting unit 30.

Note that, the configurations of the banknote handling apparatuses 10 and 10*a* according to the present embodiment are not limited to the embodiments mentioned above and can be changed as desired in various manner.

In the above explanation, in the banknote handling apparatus 10 shown in FIGS. 1 to 4 and the banknote handling apparatus 10*a* shown in FIGS. 5 and 6, an explanation has been given of a situation in which the lower assembly 14 is reversed front-back; however, the configuration is not limited to this. It is allowable that, in the banknote handling apparatus 10 shown in FIGS. 1 to 4 and the banknote handling apparatus 10*a* shown in FIGS. 5 and 6, the upper assembly 12 is reversible front-back instead of the lower assembly 14. Even in this embodiment, the positions of the communication parts 29 of the upper assembly 12 and the positions of the communication parts 42 of the lower assembly 14 match when the upper assembly 12 is reversed front-back. When reversing the upper assembly 12 or the lower assembly 14 front-back, the upper assembly 12 or the lower assembly 14 can be rotated around an axis that passes through a center of a length along the front-back direction of the upper assembly 12 or the lower assembly 14, or the upper assembly 12 or the lower assembly 14 can be rotated around an axis that passes through a center between a position of the communication parts 29 and 42 located most front and a position of the communication parts 29 and 42 located most back. That is, the rotation can be performed around any axis as long as the communication parts 29 and 42 match when either the upper assembly 12 or the lower assembly 14 is reversed front-back.

In the banknote handling apparatus 10 shown in FIGS. 1 to 4 and the banknote handling apparatus 10*a* shown in FIGS. 5 and 6, the upper assembly 12 can be reversed left-right. Even in this embodiment, the positions of the communication parts 29 of the upper assembly 12 and the positions of the communication parts 42 of the lower assembly 14 match when the upper assembly 12 is reversed left-right. When reversing the upper assembly 12 or the lower assembly 14 left-right, the upper assembly 12 or the lower assembly 14 can be rotated around an axis that passes through a center of a length along the left-right direction of the upper assembly 12 or the lower assembly 14, or the upper assembly 12 or the lower assembly 14 can be rotated around an axis that passes through a center between a position of the communication parts 29 and 42 located most right and a position of the communication parts 29 and 42 located most left. That is, the rotation can be performed around any axis as long as the communication parts 29 and 42 match when either the upper assembly 12 or the lower assembly 14 is reversed left-right.

It is not necessary that the communication parts arranged in the bottom part of the upper assembly 12 and the communication parts arranged in the upper part of the lower assembly 14 are plural. That is, only one communication part can be arranged in each of the bottom part of the upper assembly 12 and the upper part of the lower assembly 14. In this configuration, only one banknote storage cassette 40 is mounted inside the lower assembly 14. Even in the banknote handling apparatuses 10 and 10*a* having such a configuration, according to the present embodiments, either the upper assembly 12 or the lower assembly 14 is reversible, and the position of the communication part of the upper assembly 12 and the position of the communication part of the lower assembly 14 match when either the upper assembly 12 or the lower assembly 14 is reversed.

Figure 7:
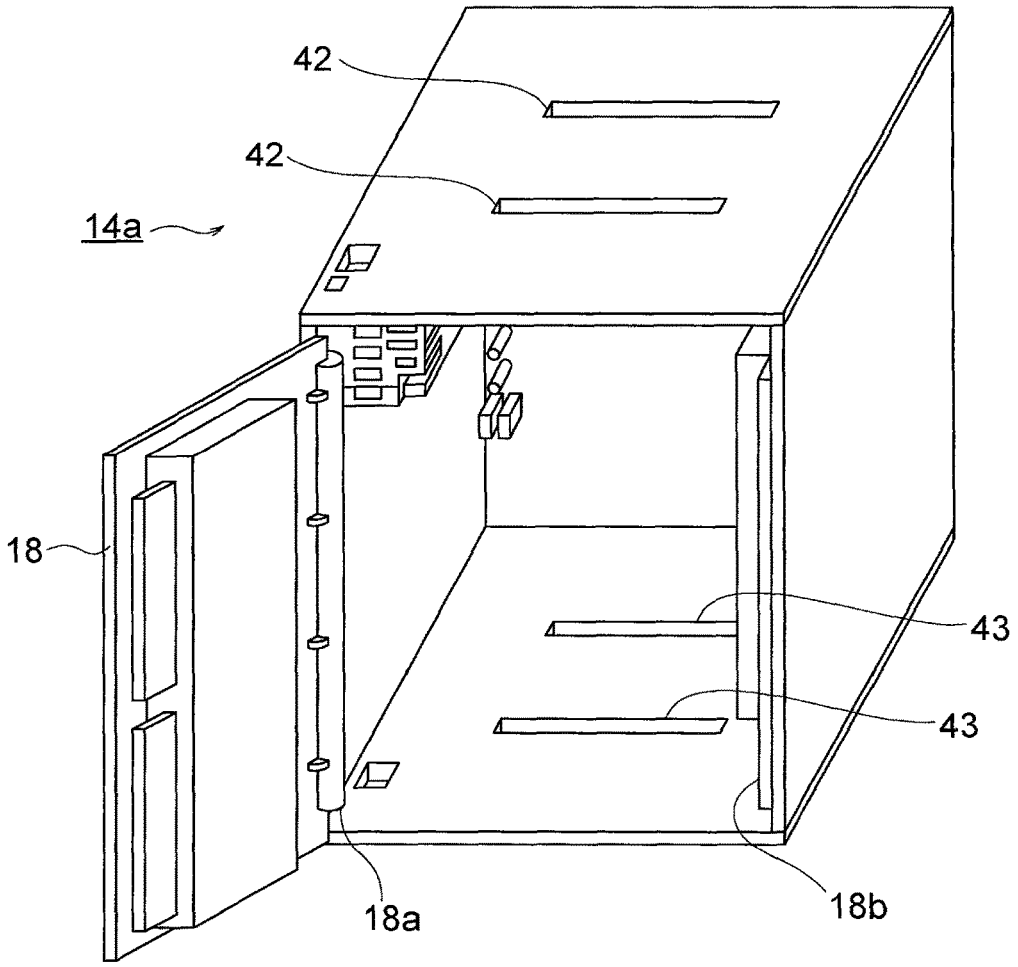
FIG. 7 is a perspective view of a configuration of a lower assembly in a banknote handling apparatus according to a variation.
Figure 8:
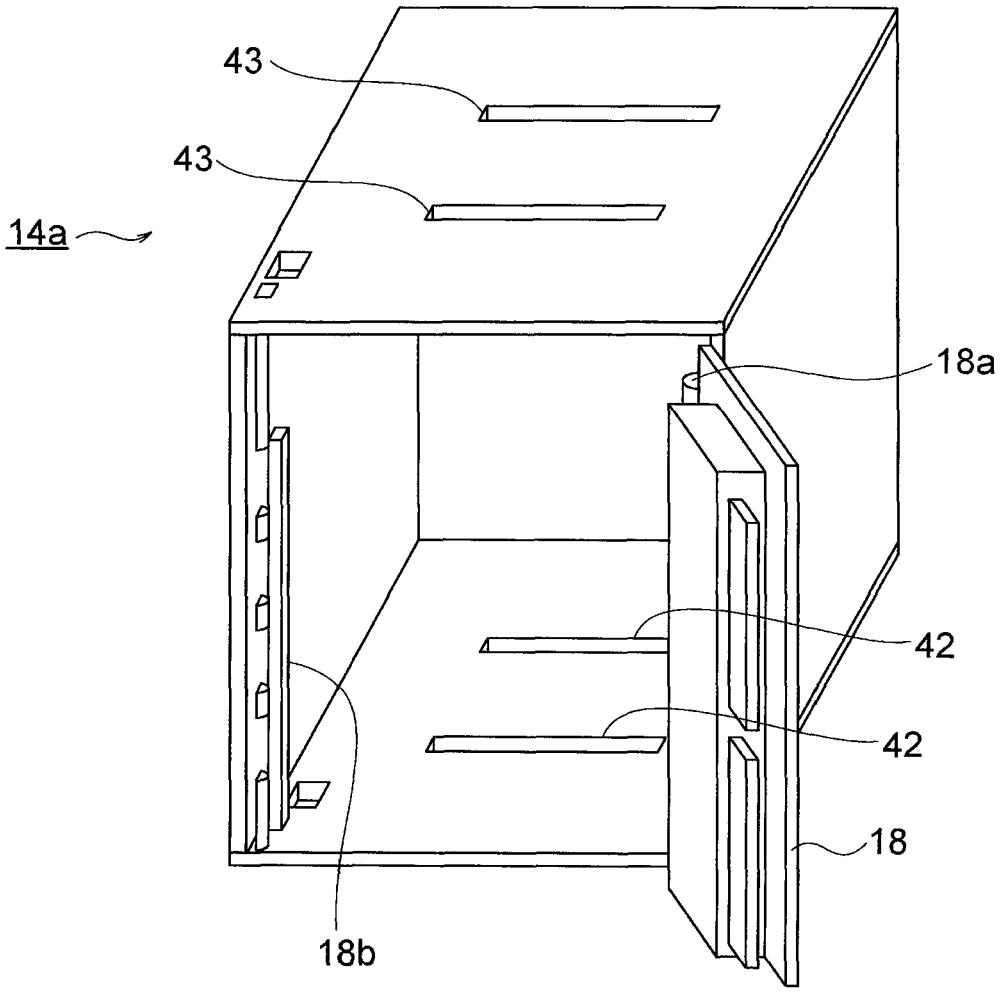
FIG. 8 is a perspective view of a configuration when the lower assembly shown in FIG. 7 is reversed up-down.

In the present embodiment, it is allowable to use as the lower assembly a lower assembly 14*a* having a configuration shown in FIGS. 7 and 8. FIG. 7 is a perspective view of a configuration of the lower assembly 14*a* in a banknote handling apparatus according to a variation. FIG. 8 is a perspective view of a configuration when the lower assembly 14*a* shown in FIG. 7 is reversed up-down. Note that, in the explanation of the configuration of the lower assembly 14*a* shown in FIGS. 7 and 8, the same reference numbers have been used for the structural components that are the same as those in the lower assembly 14 of the banknote handling apparatus 10 shown in FIGS. 1 to 4 or the banknote handling apparatus 10*a* shown in FIGS. 5 and 6 and the explanation thereof has been omitted.

In the banknote handling apparatus according to the variation having the lower assembly 14*a* shown in FIG. 7 and the like, the lower assembly 14*a* can be reversed up-down. Specifically, as shown in FIG. 7, a plurality (specifically, two) of the communication parts 42 each of which corresponds with each of a plurality of the banknote storage cassettes 40 that should be mounted in the lower assembly 14*a* is arranged in an upper part of the lower assembly 14*a*, and a plurality (specifically, two) of communication parts 43 each of which corresponds with each of the banknote storage cassettes 40 that should be mounted in the lower assembly 14*a* is arranged even in a bottom part of the lower assembly 14*a*. Even when the lower assembly 14*a* is reversed up-down from the state of the lower assembly 14*a* shown in FIG. 7 to take the state shown in FIG. 8, a position of each of the communication parts 43 of the lower assembly 14*a* that oppose the upper assembly 12 and a position of the corresponding communication part 29 of the upper assembly 12 match.

More particularly, in the banknote handling apparatus according to the variation having the lower assembly 14*a* shown in FIG. 7 and the like, the communication parts 43 arranged in the bottom part of the lower assembly 14*a* are arranged symmetrically with respect to a substantially central position in a front-back direction (that is, a depth direction in FIG. 7) of the lower assembly 14*a*. Also, the communication parts 43 are arranged symmetrically with respect to a substantially central position in a width direction (that is, a left-right direction in FIG. 7) of the lower assembly 14*a*. Moreover, as explained above, the communication parts 29 of the upper assembly 12 are arranged symmetrically with respect to the substantially central position in the front-back direction of the upper assembly 12.

Also, the communication parts 29 are arranged symmetrically with respect to the substantially central position in the width direction of the upper assembly 12. Accordingly, the position of each of the communication parts 43 of the lower assembly 14*a* matches with the position of the corresponding communication part 29 of the upper assembly 12 when the lower assembly 14*a* is reversed up-down.

In the lower assembly 14*a* shown in FIG. 7 and the like, the laterally opening door 18 is arranged in either a front surface or a back surface (the door 18 is arranged in the front surface in the example shown in FIG. 7) thereof; however, the opening direction of the door 18 of the lower assembly 14*a* is reversed as shown in FIG. 8 when the lower assembly 14*a* is reversed up-down. Specifically, the door 18 of the lower assembly 14*a* shown in FIG. 7 opens to the left whereas the door 18 of the lower assembly 14*a* shown in FIG. 8 opens to the right. In the lower assembly 14*a* shown in FIG. 7 and the like, the handle 16 attached to the door 18 can have a configuration in which the orientation thereof can be reversed up-down. In this configuration, by changing the orientation of the handle 16 after reversing the lower assembly 14*a* up-down, the operationality of the handle 16 can be maintained to that when the lower assembly 14*a* is not reversed up-down even when the lower assembly 14*a* is reversed up-down.

As explained above, according to the banknote handling apparatus of the variation having the lower assembly 14*a* shown in FIG. 7 and the like, the position of each of the communication parts 43 of the lower assembly 14*a* that oppose the upper assembly 12 and the position of the corresponding communication part 29 of the upper assembly 12 match when the lower assembly 14*a* is reversed up-down. Therefore, when the laterally opening door 18 is arranged in the front surface or the back surface of the lower assembly 14*a*, by reversing the lower assembly 14*a* up-down, the same banknote handling apparatus can be suitably used as an apparatus in which the door 18 opens to the left and an apparatus in which the door 18 opens to the right.

Moreover, in the lower assembly 14*a* shown in FIG. 7, a hinge 18*a* is provided on one edge of the door 18. Moreover, a rod-like member 18*b* is arranged on each of two sides of an opening on the front surface of the lower assembly 14*a* so as to extend in the up-down direction. The hinge 18*a* is detachably attachable to either of the rod-like members 18*b* between the two rod-like members 18*b*. The door 18 pivots around the hinge 18*a* attached to the rod-like member 18*b* from the opening on the front surface of the lower assembly 14*a* toward the front side thereby opening the opening. Note that, in FIG. 7, the hinge 18*a* is attached to the rod-like member 18*b* on the left side (this rod-like member 18*b* has not be shown in FIG. 7 as it is hidden under the hinge 18*a*) between the two rod-like members 18*b*, and the door 18 pivots around the hinge 18*a* toward the front side from the opening on the front surface of the lower assembly 14*a*.

In the lower assembly 14*a* having such a configuration, by attaching the hinge 18*a* of the door 18 to an appropriate one of the rod-like members 18*b*, the door 18 can be caused to open to either the right side or the left side as desired. That is, even if the state of the lower assembly 14*a* changes from the state shown in FIG. 7 to the state shown in FIG. 8 because of reversing up-down, by detaching the hinge 18*a* from the rod-like member 18*b* on the right side in FIG. 8 and attaching the hinge 18*a* to the rod-like member 18*b* on the left side, the door 18 can be caused to open to the left side as before even the lower assembly 14*a* is reversed up-down. Moreover, in this case, it is not necessary to reverse the handle 16 up-down.

Figure 9:
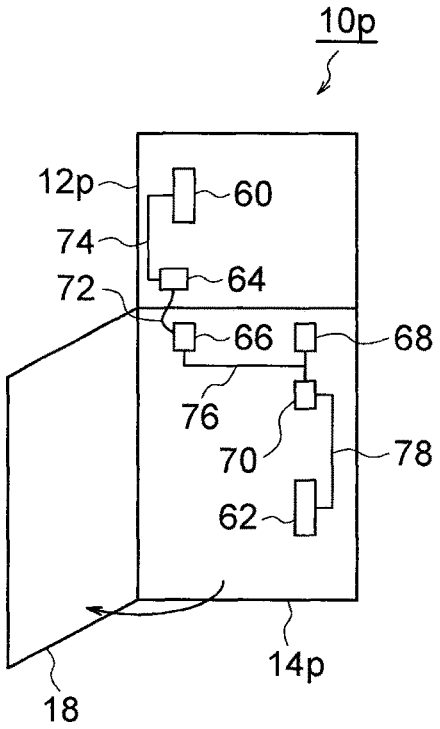
FIGS. 9(*a*) and 9(*b*) depict wiring of a control system of a banknote handling apparatus according to another variation, in which FIG. 9(*a*) is a front view indicating a configuration when the banknote handling apparatus is seen from a front side when the same is used as a front operational type, and FIG. 9(*b*) is a front view indicating a configuration when the banknote handling apparatus is seen from a front side when the same is used as a back operational type.
Figure 9:
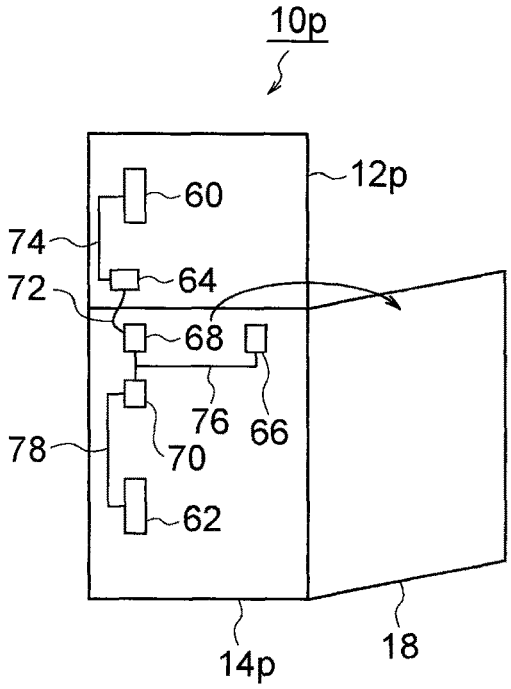
Figure 10:
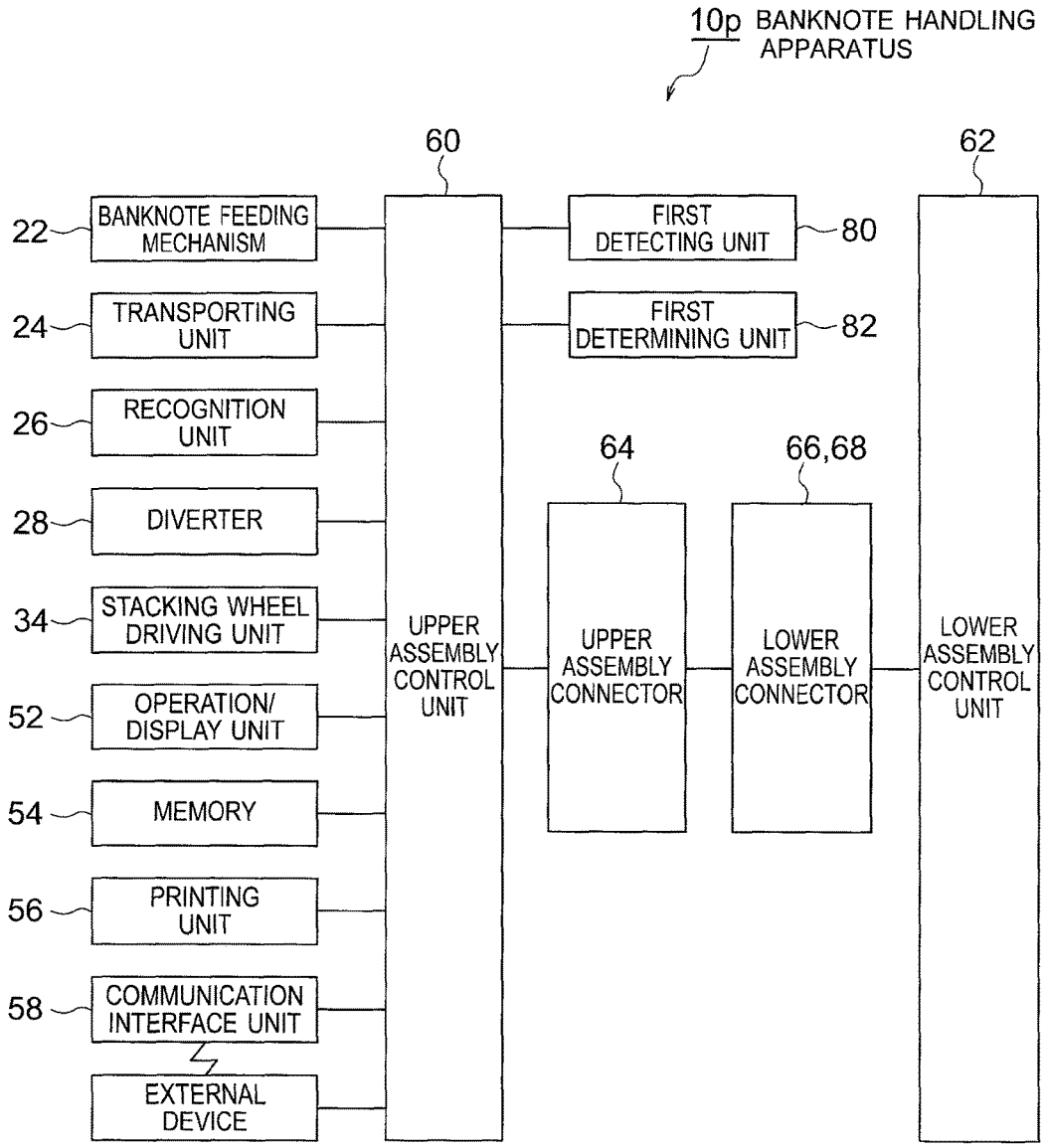
FIG. 10 is a functional block diagram indicating a configuration of the control system in the banknote handling apparatus shown in FIG. 9.

Moreover, a banknote handling apparatus 10*p* shown in FIGS. 9 and 10 can be used as a banknote handling apparatus according to yet another configuration. FIG. 9(*a*) is a view depicting a wiring of a control system of the banknote handling apparatus 10*p* when the same is seen from the front side when the same is used as the front operational type, and FIG. 9(*b*) is a view depicting a wiring of the control system of the banknote handling apparatus 10*p* when the same is seen from the front side when the same is used as the back operational type. FIG. 10 is a functional block diagram indicating a configuration of the control system in the banknote handling apparatus 10*p*.

The banknote handling apparatus 10*p* shown in FIGS. 9 and 10 is different from the banknote handling apparatuses 10 and 10*a* shown in FIGS. 1 to 6 in the point that, in the banknote handling apparatus 10*p*, an upper assembly 12*p* includes an upper assembly control unit 60 and a lower assembly 14*p* includes a lower assembly control unit 62. The other structure of the banknote handling apparatus 10*p* is substantially the same as the banknote handling apparatuses 10 and 10*a* shown in FIGS. 1 to 6. Note that, in the explanation of the banknote handling apparatus 10*p* shown in FIGS. 9 and 10, the same reference numbers have been used for the structural components that are the same as those in the banknote handling apparatuses 10 and 10*a* shown in FIGS. 1 to 6 and the explanation thereof has been omitted.

In the banknote handling apparatus 10*p* shown in FIGS. 9 and 10, a connector 64 (upper assembly connecting unit) is arranged in a left lower part in the upper assembly 12*p* when the banknote handling apparatus 10*p* is seen from the front side. The upper assembly control unit 60 and the connector 64 are connected by wiring 74. In an alternative configuration, the connector 64 can be included in the upper assembly control unit 60. Moreover, to handle a situation in which the banknote handling apparatus 10*p* is used as the front operational type, a relay connector 70 is arranged in a right upper part in the lower assembly 14*p* when the banknote handling apparatus 10*p* is seen from the front side. The lower assembly control unit 62 and the relay connector 70 are connected by wiring 78. In an alternative configuration, the relay connector 70 can be included in the lower assembly control unit 62. Moreover, to handle the situation in which the banknote handling apparatus 10*p* is used as the front operational type, a first connector 66 and a second connector 68 (lower assembly connecting unit) are arranged in a right upper part and a left upper part, respectively, in the lower assembly 14*p* when the banknote handling apparatus 10*p* is seen from the front side. The relay connector 70 is connected to wiring 76 that is divided into two parts. The first connector 66 and the second connector 68 are connected to each of the ends of the two parts of the wiring 76.

When using the banknote handling apparatus 10*p* as the front operational type, as shown in FIG. 9(*a*), the connector 64 arranged in the upper assembly 12*p* and the first connector 66 arranged in the left upper part in the lower assembly 14*p* are connected by wiring 72. Alternatively, when using the banknote handling apparatus 10*p* as the back operational type, because the lower assembly 14*p* is reversed left-right from the state thereof shown in FIG. 9(*a*), as shown in FIG. 9(*b*), the connector 64 arranged in the upper assembly 12*p* and the second connector 68 arranged in the lower assembly 14*p* are connected by the wiring 72. In this manner, by connecting the connector 64 arranged in the upper assembly 12*p* to one connector between the first connector 66 and the second connector 68 that are arranged in the lower assembly 14*p*, signals can be exchanged between the upper assembly control unit 60 and the lower assembly control unit 62. Moreover, wiring for supplying power is also laid in the same manner as the above-mentioned wiring for control.

To one between the upper assembly control unit 60 and the lower assembly control unit 62 are connected a first detecting unit 80 that detects to which connector between the first connector 66 and the second connector 68 arranged in the lower assembly 14*p* the connector 64 arranged in the upper assembly 12*p* is connected, and a first determining unit 82 that determines an orientation of the lower assembly 14*p* with respect to the upper assembly 12*p* based on a detection result output from the first detecting unit 80. Note that, in the example shown in FIG. 10, the first detecting unit 80 and the first determining unit 82 are connected to the upper assembly control unit 60; however, one between or both of the first detecting unit 80 and the first determining unit 82 can be connected to the lower assembly control unit 62. When it is detected by the first detecting unit 80 that the connector 64 arranged in the upper assembly 12*p* has been connected to the first connector 66 arranged in the lower assembly 14*p*, the first determining unit 82 determines that the apparatus is the front operational type in which the opening and closing of the door 18 of the lower assembly 14*p* are performed from the side that is the same as the side on which the receiving unit 20 and the ejecting unit 30 are arranged in the upper assembly 12*p*. When it is detected by the first detecting unit 80 that the connector 64 arranged in the upper assembly 12*p* has been connected to the second connector 68 arranged in the lower assembly 14*p*, the first determining unit 82 determines that the apparatus is the back operational type in which the opening and closing of the door 18 of the lower assembly 14*p* are performed from the opposite side of the side on which the receiving unit 20 and the ejecting unit 30 are arranged in the upper assembly 12*p*. In this manner, in the banknote handling apparatus 10*p* shown in FIGS. 9 and 10, based on which connector among the first connector 66 and the second connector 68 arranged in the lower assembly 14*p* is being used, the orientation of the lower assembly 14*p* with respect to the upper assembly 12*p* can be automatically detected. According to the banknote handling apparatus 10*p*, an operation in which the operator manually sets the orientation of the lower assembly 14*p* with respect to the upper assembly 12*p*, for example, by using the operation/display unit 52, can be omitted. Thus, an occurrence of error in setting the orientation of the lower assembly 14*p* by the operator can be prevented.

In the banknote handling apparatus 10*p* shown in FIGS. 9 and 10, the display content of the operation/display unit 52 can be changed based on a determination result obtained in the first determining unit 82. That is, mutually different display contents can be displayed on the operation/display unit 52 when it is determined by the first determining unit 82 that the apparatus is the front operational type and when it is determined by the first determining unit 82 that the apparatus is the back operational type. Examples of the display contents to be changed can include a numbering configuration of a cassette number of the banknote storage cassettes 40, display of operation guidance screens such as an error cancellation screen, and the like. Furthermore, not only the display contents but also an operation control of the banknote handling apparatus 10*p* can be changed. For example, a control relating to a transport destination of the banknote in the transporting unit 24 can be changed.

Figure 11:
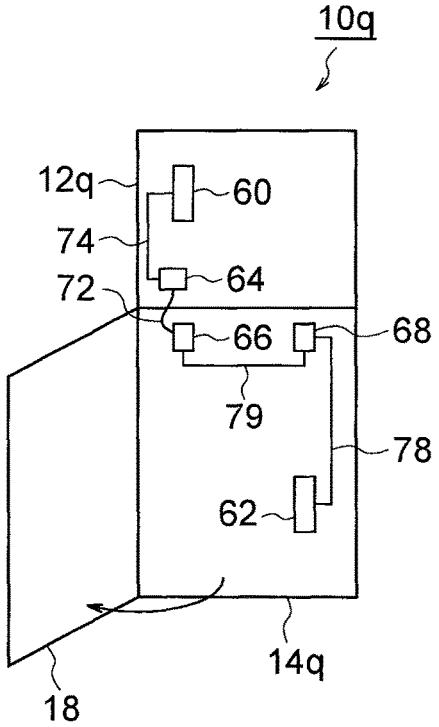
FIGS. 11(*a*) and 11(*b*) depict wiring of a control system of a banknote handling apparatus according to yet another variation, in which FIG. 11(*a*) is a front view indicating a configuration when the banknote handling apparatus is seen from a front side when the same is used as the front operational type, and FIG. 11(*b*) is a front view indicating a configuration when the banknote handling apparatus is seen from a front side when the same is used as the back operational type.
Figure 11:
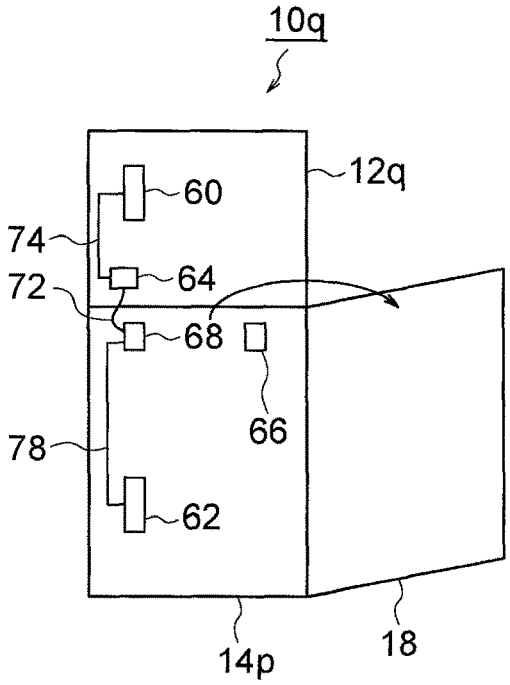
Figure 12:
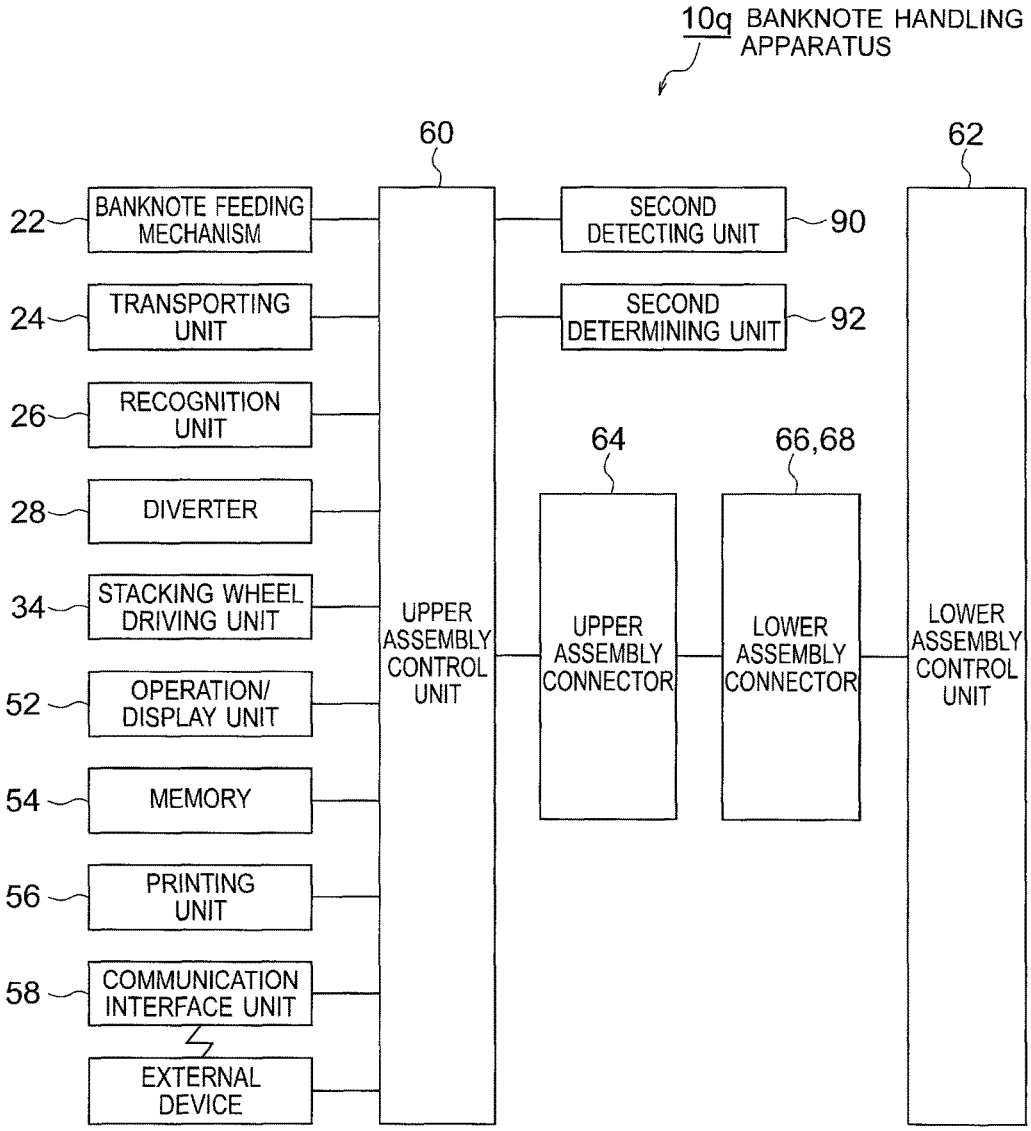
FIG. 12 is a functional block diagram indicating a configuration of the control system in the banknote handling apparatus shown in FIG. 10.

Moreover, a banknote handling apparatus 10*q* shown in FIGS. 11 and 12 can be used as a banknote handling apparatus according to yet another configuration. FIG. 11(*a*) is a view depicting wiring of a control system of the banknote handling apparatus 10*q* when the same is seen from the front side when the same is used as the front operational type, and FIG. 11(*b*) is a view depicting wiring of the control system of the banknote handling apparatus 10*q* when the same is seen from the front side when the same is used as the back operational type. FIG. 12 is a functional block diagram indicating a configuration of the control system in the banknote handling apparatus 10*q*.

The banknote handling apparatus 10*q* shown in FIGS. 11 and 12 is different from the banknote handling apparatuses 10 and 10*a* shown in FIGS. 1 to 6 in the point that, in the banknote handling apparatus 10*q*, an upper assembly 12*q* includes an upper assembly control unit 60 and a lower assembly 14*q* includes a lower assembly control unit 62. The other structure of the banknote handling apparatus 10*q* is substantially the same as the banknote handling apparatuses 10 and 10*a* shown in FIGS. 1 to 6. Note that, in the explanation of the banknote handling apparatus 10*q* shown in FIGS. 11 and 12, the same reference numbers have been used for the structural components that are the same as those in the banknote handling apparatuses 10 and 10*a* shown in FIGS. 1 to 6 and the explanation thereof has been omitted.

In the banknote handling apparatus 10*q* shown in FIGS. 11 and 12, a connector 64 (upper assembly connecting unit) is arranged in a left lower part in the upper assembly 12*q* when the banknote handling apparatus 10*q* is seen from the front side. The upper assembly control unit 60 and the connector 64 are connected by wiring 74. Moreover, to handle the situation in which the banknote handling apparatus 10*q* is used as the front operational type, a first connector 66 and a second connector 68 (lower assembly connecting unit) are arranged in a right upper part and a left upper part, respectively, in the lower assembly 14*q* when the banknote handling apparatus 10*q* is seen from the front side. Moreover, the second connector 68 and the lower assembly control unit 62 are connected by wiring 78.

When using the banknote handling apparatus 10*q* as the front operational type, as shown in FIG. 11(*a*), the first connector 66 and the second connector 68 are connected by a relay harness 79 (connection assisting unit). Moreover, the connector 64 arranged in the upper assembly 12*q* and the first connector 66 arranged in the left upper part in the lower assembly 14*q* are connected by wiring 72. When using the banknote handling apparatus 10*q* as the back operational type, because the lower assembly 14*q* is reversed left-right, as shown in FIG. 11(*b*), without connecting the first connector 66 and the second connector 68 by the relay harness 79, the connector 64 arranged in the upper assembly 12*q* and the second connector 68 are connected by the wiring 72. In this manner, by connecting the connector 64 arranged in the upper assembly 12*q* to one connector amoung the first connector 66 and the second connector 68 arranged in the lower assembly 14*q*, signals can be exchanged between the upper assembly control unit 60 and the lower assembly control unit 62. Moreover, wiring for supplying power is also laid in the same manner as the above-mentioned wiring for control.

To one among the upper assembly control unit 60 and the lower assembly control unit 62 are connected a second detecting unit 90 that detects, when the upper assembly control unit 60 and the lower assembly control unit 62 are connected to each other, whether the connector 64 arranged in the upper assembly 12*q* is directly connected to the first connector 66 or to the second connector 68 that are arranged in the lower assembly 14*q* or the connector 64 is connected to the first connector 66 or to the second connector 68 via the relay harness 79, and a second determining unit 92 that determines an orientation of the lower assembly 14*q* with respect to the upper assembly 12*q* based on a detection result output from the second detecting unit 90. When the upper assembly control unit 60 and the lower assembly control unit 62 are connected to each other, if it is detected that the relay harness 79 has been used, the second determining unit 92 determines that the apparatus is the front operational type in which the opening and closing of the door 18 of the lower assembly 14*q* are performed from the side that is the same as the side on which the receiving unit 20 and the ejecting unit 30 are arranged in the upper assembly 12*q*. Alternatively, when the upper assembly control unit 60 and the lower assembly control unit 62 are connected to each other, if it is detected that the relay harness 79 has not been used, the second determining unit 92 determines that the apparatus is the back operational type in which the opening and closing of the door 18 of the lower assembly 14*q* are performed from the opposite side of the side on which the receiving unit 20 and the ejecting unit 30 are arranged in the upper assembly 12*q*. In this manner, in the banknote handling apparatus 10*q* shown in FIGS. 11 and 12, based on whether the relay harness 79 has been used in connecting the upper assembly control unit 60 and the lower assembly control unit 62 to each other, the orientation of the lower assembly 14*p* with respect to the upper assembly 12*p* can be automatically detected. According to the banknote handling apparatus 10*q*, an operation in which the operator manually sets the orientation of the lower assembly 14*q* with respect to the upper assembly 12*q*, for example, by using the operation/display unit 52, can be omitted. Thus, an occurrence of error in setting the orientation of the lower assembly 14*q* by the operator can be prevented.

In the banknote handling apparatus 10*q* shown in FIGS. 11 and 12, the display content of the operation/display unit 52 can be changed based on a determination result obtained in the second determining unit 92. That is, mutually different display contents can be displayed on the operation/display unit 52 when it is determined by the second determining unit 92 that the apparatus is the front operational type and when it is determined by the second determining unit 92 that the apparatus is the back operational type.

Figure 13:
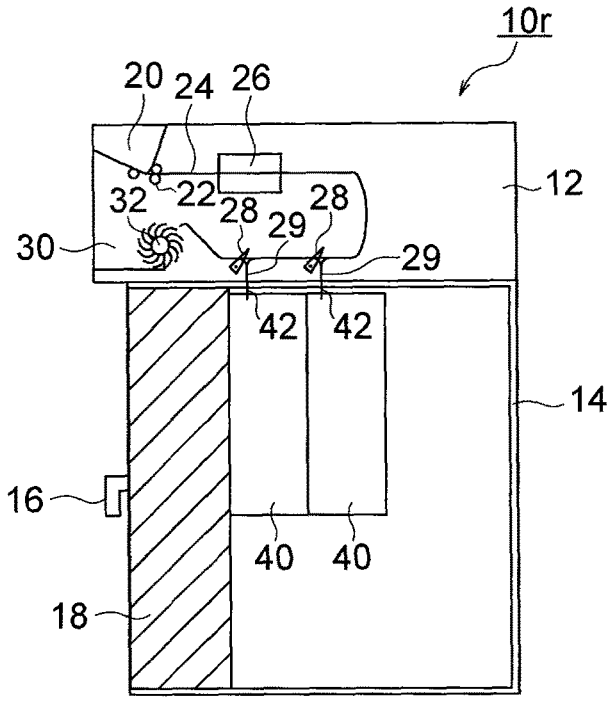
FIGS. 13(*a*) and 13(*b*) are schematic configurational diagrams that show an overall configuration of a banknote handling apparatus according to yet another variation, in which FIG. 13(*a*) is a view of an internal configuration of the banknote handling apparatus when the same is used as the front operational type, and FIG. 13(*b*) is a view of an internal configuration of the banknote handling apparatus when the same is used as the back operational type.
Figure 13:
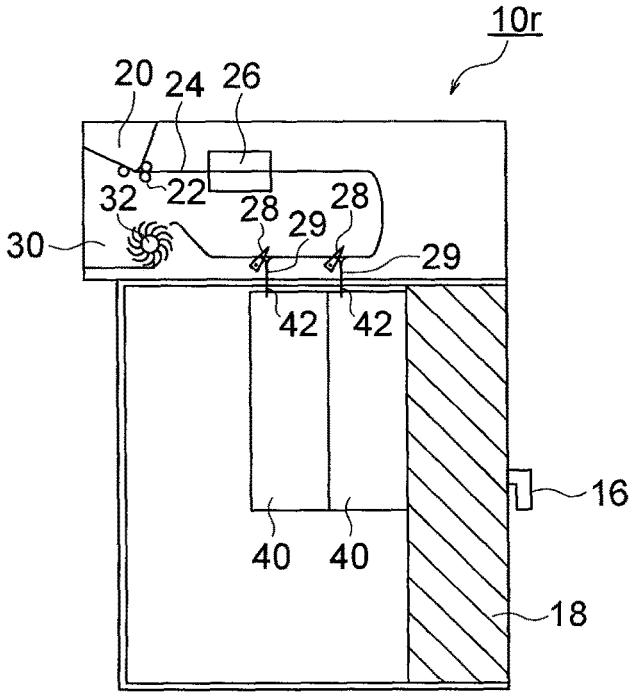

Moreover, a banknote handling apparatus 10*r* shown in FIG. 13 can be used as a banknote handling apparatus according to yet another configuration. FIG. 13(*a*) is a view of an internal configuration of the banknote handling apparatus 10*r* when the same is used as the front operational type, and FIG. 13(*b*) is a view of the internal configuration of the banknote handling apparatus 10*r* when the same is used as the back operational type.

The banknote handling apparatus 10*r* shown in FIG. 13 is different from the banknote handling apparatuses 10 and 10*a* shown in FIGS. 1 to 6 in the point that, in the banknote handling apparatus 10*r*, the orientations of the banknote storage cassettes 40 housed inside the lower assembly 14 do not change when the lower assembly 14 is reversed front-back. The other structure of the banknote handling apparatus 10*r* is substantially the same as the banknote handling apparatuses 10 and 10*a* shown in FIGS. 1 to 6. Note that, in the explanation of the banknote handling apparatus 10*r* shown in FIG. 13, the same reference numbers have been used for the structural components that are the same as those in the banknote handling apparatuses 10 and 10*a* shown in FIGS. 1 to 6 and the explanation thereof has been omitted.

In the banknote handling apparatus 10*r* according to the yet another variation, as shown in FIGS. 13(*a*) and 13(*b*), the positions of the communication parts 42 of the lower assembly 14 are set so that the orientations of the banknote storage cassettes 40 housed inside the lower assembly 14 do not change when the lower assembly 14 is reversed front-back. Accordingly, the orientations of the banknote storage cassettes 40 does not change irrespective of whether the banknote handling apparatus 10*r* is used as the front operational type or used as the back operational type.

The banknote handling apparatus according to the present embodiment is not limited to a banknote depositing machine that performs depositing process of the banknotes shown in FIG. 1 and the like. A banknote dispensing machine that performs dispensing process of the banknotes, a teller machine or an ATM (automatic teller machine) installed in a financial institution and the like, and the like can be used as the banknote handling apparatus according to the present embodiment. When the banknote dispensing machine that performs dispensing process of the banknotes is used as the banknote handling apparatus according to the present embodiment, a dispensing reject unit for storing a banknote that is recognized as being not a normal banknote when performing dispensing process of the banknotes can be provided in either the upper assembly or the lower assembly.

The paper sheet handling apparatus according to the present invention is not limited to the above-explained banknote handling apparatuses that perform various processes such as depositing process of the banknotes. As the paper sheet handling apparatus according to the present invention, an apparatus that can handle, other than the banknotes, paper sheets constituting valuable media such as a check, a gift voucher, and the like can be used.

The concept of the present invention can be applied also to a coin handling apparatus that handles coins. That is, the coin handling apparatus can have the following configuration. That is, the coin handling apparatus includes an upper assembly arranged above a lower assembly, in a configuration in which a coin received in a receiving unit of the upper assembly is sent from the upper assembly to the lower assembly and stored in the lower assembly, communication part or parts are arranged in a bottom part of the upper assembly and communication part or parts are arranged in an upper part of the lower assembly for exchanging coins between the upper assembly and the lower assembly, and the number of the communication part or parts of the upper assembly and the number of the communication part or parts of the lower assembly are same. In this configuration, either the upper assembly or the lower assembly is reversible either front-back or left-right, and the position ro positions of the communication part or parts of the upper assembly and the position or positions of the communication part or parts of the lower assembly match when either the upper assembly or the lower assembly is reversed.

The invention claimed is:

1. A paper sheet handling apparatus comprising:

an upper assembly having at least one of a receiving unit that receives a paper sheet and an ejecting unit that ejects the paper sheet; and a transporting unit that transports the paper sheet; and a lower assembly having a storage unit for storing the paper sheet and an inside which is accessible, wherein at least one communication part is arranged in a bottom part of the upper assembly and at least one communication part is arranged in an upper part of the lower assembly for exchanging the paper sheet between the upper assembly and the lower assembly, the number of the communication part or parts of the upper assembly and the number of the communication part or parts of the lower assembly are the same, a position of the communication part(s) of the upper assembly and a position of the communication part(s) of the lower assembly match when the upper assembly or the lower assembly is reversed, and a plurality of the storage units are arranged side by side along a horizontal direction inside the lower assembly.

2. The paper sheet handling apparatus as claimed in claim 1, wherein the communication parts of the upper assembly and the communication parts of the lower assembly are provided in a plurality, and the position of each of the communication parts of the lower assembly matches with the position of the corresponding communication part of the upper assembly when the upper assembly or the lower assembly is reversed.

3. The paper sheet handling apparatus as claimed in claim 2, wherein the communication parts of the upper assembly are arranged symmetrically with respect to a substantially central position in a front-back direction of the upper assembly.

4. The paper sheet handling apparatus as claimed in claim 2, wherein the communication parts of the upper assembly are arranged symmetrically with respect to a substantially central position in a width direction that is orthogonal to the front-back direction of the upper assembly.

5. The paper sheet handling apparatus as claimed in claim 2, wherein the communication parts of the lower assembly are arranged symmetrically with respect to a substantially central position in a front-back direction of the lower assembly.

6. The paper sheet handling apparatus as claimed in claim 2, wherein the communication parts of the lower assembly are arranged symmetrically with respect to a substantially central position in a width direction that is orthogonal to the front-back direction of the lower assembly.

7. The paper sheet handling apparatus as claimed in claim 1, wherein the paper sheet sent from the communication part of the upper assembly to the communication part of the lower assembly is stored in the storage unit of the lower assembly without being diverted.

8. The paper sheet handling apparatus as claimed in claim 7, wherein the storage units are provided in a plurality.

9. The paper sheet handling apparatus as claimed in claim 8, wherein all the storage units have the same configuration.

10. The paper sheet handling apparatus as claimed in claim 7, wherein the number of the storage units and the number of the communication parts of the lower assembly are the same.

11. The paper sheet handling apparatus as claimed in claim 1, wherein the lower assembly constitutes a safe into which only a person having a predetermined authority is capable of accessing the inside of the lower assembly, and the communication part is an opening part provided in the safe.

12. The paper sheet handling apparatus as claimed in claim 1, wherein the communication part or parts of the upper assembly number the same as the communication part or parts arranged in a bottom part of the lower assembly, and a position of each of the communication part or parts of the lower assembly that oppose the upper assembly and a position of the corresponding communication part or parts of the upper assembly match when the lower assembly is reversed up-down.

13. The paper sheet handling apparatus as claimed in claim 12, wherein a laterally opening door is arranged on either a front surface or a back surface of the lower assembly, and the door is configured so that an opening direction thereof is reversed when the lower assembly is reversed up-down.

14. The paper sheet handling apparatus as claimed in claim 1, further comprising:

a lower assembly control unit arranged inside the lower assembly for controlling each structural component of the lower assembly;

an upper assembly control unit arranged inside the upper assembly for controlling each structural component of the upper assembly;

an upper assembly connecting unit to be connected to the lower assembly control unit;

a lower assembly connecting unit to be connected to the upper assembly control unit;

a second detecting unit that detects whether the upper assembly connecting unit is directly connected to the lower assembly connecting unit or connected via a connection assisting unit when connecting the upper assembly control unit and the lower assembly control unit to each other; and a second determining unit that determines an orientation of the lower assembly with respect to the upper assembly based on a detection result obtained in the second detecting unit.

15. The paper sheet handling apparatus as claimed in claim 14, further comprising a display unit, wherein a display content of the display unit is changed based on the determination result obtained in the second determining unit.

16. A paper sheet handling apparatus comprising:

an upper assembly having at least one of a receiving unit that receives a paper sheet and an electing unit that ejects the paper sheet; and a transporting unit that transports the paper sheet; and a lower assembly having a storage unit for storing the paper sheet and an inside which is accessible;

a lower assembly control unit arranged inside the lower assembly for controlling each structural component of the lower assembly;

an upper assembly control unit arranged inside the upper assembly for controlling each structural component of the upper assembly;

an upper assembly connecting unit to be connected to the lower assembly control unit;

two lower assembly connecting units to be connected to the upper assembly control unit;

a first detecting unit that detects which between the two lower assembly connecting units the upper assembly connecting unit is connected when connecting the upper assembly control unit and the lower assembly control unit to each other;

a first determining unit that determines an orientation of the lower assembly with respect to the upper assembly based on a detection result obtained in the first detecting unit; and a display unit, wherein at least one communication part is arranged in a bottom part of the upper assembly and at least one communication part is arranged in an upper part of the lower assembly for exchanging the paper sheet between the upper assembly and the lower assembly, the number of the communication part or parts of the upper assembly and the number of the communication part or parts of the lower assembly are the same, a position of the communication part(s) of the upper assembly and a position of the communication part(s) of the lower assembly match when the upper assembly or the lower assembly is reversed, and a display content of the display unit is changed based on the determination result obtained in the first determining unit.

17. A paper sheet handling apparatus comprising:

an upper assembly having at least one of a receiving unit that receives a paper sheet and an ejecting unit that ejects the paper sheet; and a transporting unit that transports the paper sheet; and a lower assembly having a storage unit for storing the paper sheet and an inside which is accessible, wherein at least one communication part is arranged in a bottom part of the upper assembly and at least one communication part is arranged respectively in an upper part and a bottom part of the lower assembly for exchanging the paper sheet between the upper assembly and the lower assembly, the number of the communication part or parts of the upper assembly, the number of the communication part or parts arranged in the upper part of the lower assembly and the number of the communication part or parts arranged in the bottom part of the lower assembly are the same, and a position of each of the communication part or parts of the lower assembly that oppose the upper assembly and a position of the corresponding communication part or parts of the upper assembly match when the lower assembly is reversed up-down.

18. The paper sheet handling apparatus as claimed in claim 17, wherein a laterally opening door is arranged on either a front surface or a back surface of the lower assembly, and the door is configured so that an opening direction thereof is reversed when the lower assembly is reversed up-down.

* * * * *